US007562799B2

(12) United States Patent
Ueno

(10) Patent No.: US 7,562,799 B2
(45) Date of Patent: Jul. 21, 2009

(54) LOOP PIN CONNECTING DEVICE

(75) Inventor: Hideyuki Ueno, Kanagawa (JP)

(73) Assignee: M.I.T. International Co., Ltd., Yokohama-shi (JP)

( * ) Notice: Subject to any disclaimer, the term of this patent is extended or adjusted under 35 U.S.C. 154(b) by 15 days.

(21) Appl. No.: 10/871,511

(22) Filed: Jun. 18, 2004

(65) Prior Publication Data

US 2005/0001006 A1 Jan. 6, 2005

(30) Foreign Application Priority Data

Jun. 20, 2003 (JP) ..... 2003-175794

(51) Int. Cl.
*A43D 11/02* (2006.01)

(52) U.S. Cl. ..... 227/67; 227/68; 227/71; 227/144

(58) Field of Classification Search ..... 227/67, 227/71, 120, 138, 144, 145
See application file for complete search history.

(56) References Cited

U.S. PATENT DOCUMENTS 4,483,066 A * 11/1984 Akira ..... 29/811.2
4,535,926 A * 8/1985 Furutsu ..... 227/67
4,538,754 A * 9/1985 Furutsu ..... 227/67
4,838,469 A * 6/1989 Strausburg ..... 227/67
4,951,860 A * 8/1990 Peters et al. ..... 227/177.1
5,501,002 A * 3/1996 Fukami ..... 29/811.2
5,738,265 A * 4/1998 Hirai et al. ..... 227/67
5,799,375 A 9/1998 Fukami ..... 24/16
5,906,039 A * 5/1999 Fukami et al. ..... 29/566
6,364,191 B1 * 4/2002 Deschenes et al. ..... 227/67

FOREIGN PATENT DOCUMENTS

EP 1 149 770 A1 10/2001

* cited by examiner

*Primary Examiner*—Rinaldi I. Rada
*Assistant Examiner*—Nathaniel Chukwurah
(74) *Attorney, Agent, or Firm*—Greer, Burns & Crain, Ltd.

(57) ABSTRACT

A loop pin connecting device for causing mutual mating between a insertion head portion and a socket portion of a filament has a first feeding means, which feeds out the insertion head portion in front of the loop pin connecting device, and a second feeding means, which feeds out the socket portion in front of the loop pin connecting device, wherein along one stroke from a position at which the insertion head portion and the socket portion of the individual loop pins are set into the device such that the insertion head portion and socket portion are moved up to a position at which there is mutual mating therebetween, at least the first feeding means has a operation interruption mechanism capable of temporarily stopping the feeding operation at an arbitrary position during the stroke.

4 Claims, 17 Drawing Sheets

(A)

(B)

(A)

(B)

(C)

(D)

(A)

(B)

(C)

(A)

(B)

(C)

(D)

(E)

LOOP PIN CONNECTING DEVICE

BACKGROUND OF THE INVENTION

1. Field of the Invention

The present invention relates to a loop pin connecting device that can bundle together socks and the like, and that can be inserted through a product to attach such tags as brand labels, price tags, material descriptions, and instructions for use.

2. Related Art

The Japanese Patent Unexamined Patent Publication (KOKAI) No. 2001-354218 (patent reference 1) and Japanese Unexamined Patent Publication (KOKAI) No. H8-310520 (patent reference 2) are examples of related art.

In general, various loop pins and loop pin connecting devices have been used in the past for the purpose of bundling together garments, small sundry items, sandals, and shoes or the like, or attaching to such items brand labels and price tags or the like.

The configuration of a specific example of such a loop pin 10 is described below, with reference made to FIG. 7 through FIG. 12.

Specifically, the loop pin 10 shown in FIG. 7 has an flexible filament 12, an insertion head portion 13 having an appropriate mating part 16 provided on one end of the filament 12 and a socket portion 15 provided on another end of the filament 12 and having an insertion hole 14 provided with a pair of blocking blades 17, 17' therein for irreversibly passing the insertion head portion 13 therethrough, so as to mate the insertion head portion 13 and the socket portion 15 with each other.

Furthermore, this loop pin 10, similar to the above-noted example, is made so that the insertion head portion 13, the socket portion 15, and the filament 12 are integrally formed as one of, for example, of a synthetic resin such as nylon, polypropylene, or polyester or the like.

In the above-noted specific example, as shown in FIG. 8, suppose that an optional commercial good such as, for example, a bag 200 is used, after when the filament 12 is passed through a hole 410 provided beforehand in a label 400, the filament 12 with the socket portion 15 being then passed through a space formed between a handle 300 and the body of the bag 200, finally the insertion head portion 13 being passed through the insertion hole 14 of the socket portion 15, which having a function of holding the label 400, In order to improve work efficiency, a plurality of loop pins 10 are arranged in-line in a loop pin sheet 600 such as shown, for example, in FIG. 9.

Specifically, the structure of the loop pin sheet 600 is such that the individual loop pins 10 shown in FIG. 9 are provided so as to be mutually parallel and neighboring, and are caused to be connected to the connecting bars 24, 24' provided individually at or in the region of the plurality of insertion head portions 13 and at or in the vicinity of the plurality of socket portions 15, there further being a mutually linkage between the vicinity of the insertion head portions and the vicinity of the socket portions by means of the connection links 11, 11'.

The above-noted loop pin sheet 600, similar to loop pins of the past, are normally formed as one from, for example, synthetic resins such as nylon, polypropylene, or polyester or the like.

The loop pin sheet 600, as shown in FIG. 10, as indicated in Japanese Unexamined Patent Publication (KOKAI) No. H8-310520(Patent Reference No. 2), can be mounted in a loop pin connecting device 20 having an internal mechanism, and each time the operation lever 22 of the device is operated, a loop pin 10 is shot out so as to attach a label or the like to a product.

FIG. 10 shows the condition in which the loop pin sheet 600 is mounted into the loop pin connecting device 20.

FIG. 11 is an upper plan view of the loop pin connecting device 20, in which are formed vertical grooves 40, 41 into which the connecting bars 24, 24' of the loop pin sheet 600 are inserted at the left and right of the loop pin connecting device 20.

The connecting bar 24' linking the socket portions 15 of the loop pins of the loop pin sheet 600 is inserted into the vertical groove 40, and the connecting bar 24 linking the insertion head portions 13 thereof is inserted into the vertical groove 41. The loop pin connecting device 20 is provided with an out-pushing pin 42 at a position in the vicinity of the vertical groove 41 and which is driven by operation of the operation lever 22, so as to cause separation of the insertion head portion 13 from the connection link 11 of the connecting bar 24, thereby pushing out the same forward along the hollow tubular pin 21 one at a time.

The socket portion 15 is pushed outward along the guide member 43 by an appropriate out-pushing means formed as a curved hollow guide member, for example, by an out-pushing means 25 that is an out-pushing pin or a gear-rack combination, so that it mates with the insertion head portion 13 that is pushed outward by an out-pushing pin via a hollow guide 21 formed by a hollow pin at the front portion of the device.

FIG. 12 is a perspective view showing the condition of a loop pin connecting device 20 immediately before an operation whereby the loop pin connecting device 20 is used to attach a label or the like to a prescribed product is executed.

Specifically, as shown in FIG. 12, after the hole 410 of the label 400 is mated with the hollow pin 21 of the loop pin connecting device 20, the lever 22 is operated so as to hold the filament 12 to a product 200.

When performing the operating of joining the loop pin as shown the above-noted FIG. 12, in the case in which the amount of protrusion of the hollow pin 21 from the surface 26 of the loop pin connecting device 20 is made long, because the curved guide member 43 that guides the socket portion 15 in the loop pin connecting device 20 is provided in opposition to the hollow pin 21, the spacing therebetween becomes short, making it difficult to cause the curved guide member 43 to hook at or to insert into a required position on the product, thereby not only imposing an operational limitation, but also representing the cause of a lowering of work efficiency.

In the case in which the protrusion length of the hollow pin 21 from the surface 26 of the loop pin connecting device 20 is made short, not only is holding the label made difficult, but also it becomes difficult to pass the tip of the hollow pin through the small hole or small opening for the purpose of passing the loop pin, thereby greatly lowering the work efficiency.

Another example of related art used in the past is a loop pin connecting device having an internal structure as shown in the Japanese Unexamined Patent Publication (KOKAI) No. 2001-354218 (patent reference 1). The internal loop pin out-pushing mechanism of this loop pin connecting device is a simplification of the above-described loop pin connecting device of the past, but is the same as the above-described art in that the insertion head portion 13 and the socket portion 15 are fed forward and are mutually mated at an appropriate position at the front of the loop pin connecting device.

In the above-described loop pin connecting devices of the past, however, the loop pin out-pushing mechanism is one in whereby, for example, in response to operation of an operation lever by an operator pushes out each individual loop pin forward so that there is mutual mating between the insertion head portion and the socket portion in front of the loop pin connecting device, and if the operator is not accustomed to operating the loop pin connecting device, because of the complexity of the out-pushing mechanism of the loop pin connecting device, because of potential looseness in the above-noted device and because of the chance that, although the operator had thought that the operation lever was pulled sufficiently, however, actually it did not result in the insertion head portion being completely fed out to the target standard mating position, but rather stopped at a point immediately before the actual mating position, there are many cases in which the insertion head portion 13 and the socket portion 15 are seemed to be mated but there is not a complete mating, and cases in which there is either no mating or insufficient mating.

The above-noted conditions are thought to be caused by the problem of the operator not pulling the operation lever back fully up to its final position, but rather hesitating somewhat and releasing pressure at the final stage.

In a case in which there is an incomplete mating between the loop pin insertion head portion and socket portion as noted above, the operator, mistakenly assuming that there has been complete mating between the insertion head portion and the socket portion, attempts to remove the loop pin from the loop pin connecting device and, as a result, an operation is necessary to remove the loop pin from the loop pin connecting device, this being an operation performed by the operator that is not easy to perform and requires time to perform.

In addition, if the operator realizes that the loop pin mating operation has not been completed properly, the operator will often operated the lever once again with the loop pin remaining in the loop pin connecting device, thereby resulting in the out-pushing of a new loop pin with the previous loop pin remaining in the loop pin connecting device, leading to a jammed condition by contact or interference between the previous loop pin and the new loop pin, thereby requiring a complex and troublesome jam-clearing operation that greatly reduces the operating efficiency.

In a case in which a loop pin is to be used to fix or attach a price tag, label, or instructions for use to a prescribed product by means of the above-noted loop pin connecting devices, it is always necessary to have a characteristic hole, opening, space, or gap in the product for the insertion of the loop pin, and for this reason a fixed extension or protrusion is often formed on the front surface of the loop pin connecting device at or near the part at which the insertion head portion is pushed outward, so that after the extension or protrusion is first passed through the hole, opening, space, or gap, the operation lever of the loop pin connecting device is operated so as to cause mating between the insertion head portion and the socket portion.

In the loop pin connecting devices of the past, because the extension or protrusion length was fixed, in addition to the problem of being able to use the loop pin connecting device with a particular product, in order to be able to accommodate a plurality of types of products, it was necessary to provide beforehand a plurality of loop pin connecting devices having extensions or protrusions of mutually differing lengths, thereby leading to an increase in cost.

Furthermore, in a loop pin connecting device of the past, because the extension or protrusion was made of metal in order to maintain its strength, when the end part of the extension or protrusion came into contact with the hole, opening, space, or gap in the product, there were cases in which the surface of the product was damaged, thereby causing the item to lose its value as a product.

Accordingly, it is an object of the present invention to provide a loop pin connecting device for the purpose of fixing to a prescribed product a loop pin, so as to attach to the product a price tag, specifications regarding the product, or other instructions noting the method of use of the product, wherein the loop pin connecting device is capable of easily and efficiently passing the insertion head portion of the loop pin through a hole, opening, space or the like for the purpose of fixing the loop pin. Another object of the present invention is to provide a loop pin connecting device in which, when shooting in the loop pin, in the case in which the mating between the insertion head portion and the socket portion of the loop pin is insufficient or in which there has not yet been mating, the operator is caused to notice this condition, and by causing the execution of an additional remaining stroke operation, there is an improvement in the work efficiency of the loop pin connecting device and prevention of jamming of the loop pin in the loop pin connecting device.

SUMMARY OF THE INVENTION

In order to achieve the above-noted object, the present invention has the following basic technical distribution.

Specifically, a first aspect of the present invention is a loop pin connecting device that shoots out a loop pin, which has a flexible filament, an insertion head portion having an appropriate mating part provided on one end of the filament, and a socket portion having a hole on the other end of the filament for irreversibly passing the insertion head portion of the filament, so that the insertion head portion mates into the socket portion, thereby forming a loop-shaped holder. The above-noted loop pin connecting device has a first feeding means that feeds the insertion head portion toward the front of the device, and a second feeding means that feeds socket portion toward the front of the device, for the purpose of causing mutual mating between the insertion head portion and the socket portion, wherein during one stroke from a position at which the insertion head portion and the socket portion of the individual loop pins are set into the device such that the insertion head portion and socket portion are moved up to a position at which there is mutual mating therebetween, at least the first feeding means has a operation interruption mechanism capable of temporarily stopping the feeding operation at an arbitrary position during the stroke. A second aspect of the present invention is a method for connecting a loop pin having a flexible filament, an insertion head portion having an appropriate mating part provided on one end of the filament, and a socket portion having a hole on the other end of the filament for irreversibly passing the insertion head portion of the filament, so that the insertion head portion mates into the socket portion, thereby forming a loop-shaped holder, whereby, when a first feeding means feeds the insertion head portion toward the front of the device, and a second feeding means feeds the socket portion toward the front of the device, for the purpose of causing mutual mating between the insertion head portion and the socket portion, during one stroke from a position at which the insertion head portion and the socket portion of the individual loop pins are set into the device such that the insertion head portion and socket portion are moved up to a position at which there is mutual mating therebetween, the forward operation of at least the insertion head portion is caused to stop temporarily at an arbitrary position during the one operation, after which the remaining operation during the one stroke is resumed.

DETAILED DESCRIPTION OF THE PREFERRED EMBODIMENTS

By adopting the above-noted technical constitution, the present invention provides a loop pin connecting device that, in particular for the purpose of attaching a prescribed label or the like to a hole or opening of a specific product having a hole or opening, is capable of easily and efficiently passing a loop pin through the hole or opening, and when shooting the loop pin, in the case in which a situation occurs in which the mating between insertion head portion and the socket portion of the loop pin is either insufficient or has not yet occurred, the loop pin connecting device causes the operator to notice this condition to additionally resume the remaining operation for the stroke, thereby enabling efficient verification of the unmated condition of the loop pin, thereby enabling prevention of jamming of the loop pin in the loop pin connecting device, with an accompanying improvement in operating ease and efficiency.

Embodiments of a loop pin connecting device according to the present invention are described below in detail, with reference made to relevant accompanying drawings.

Figure 1:
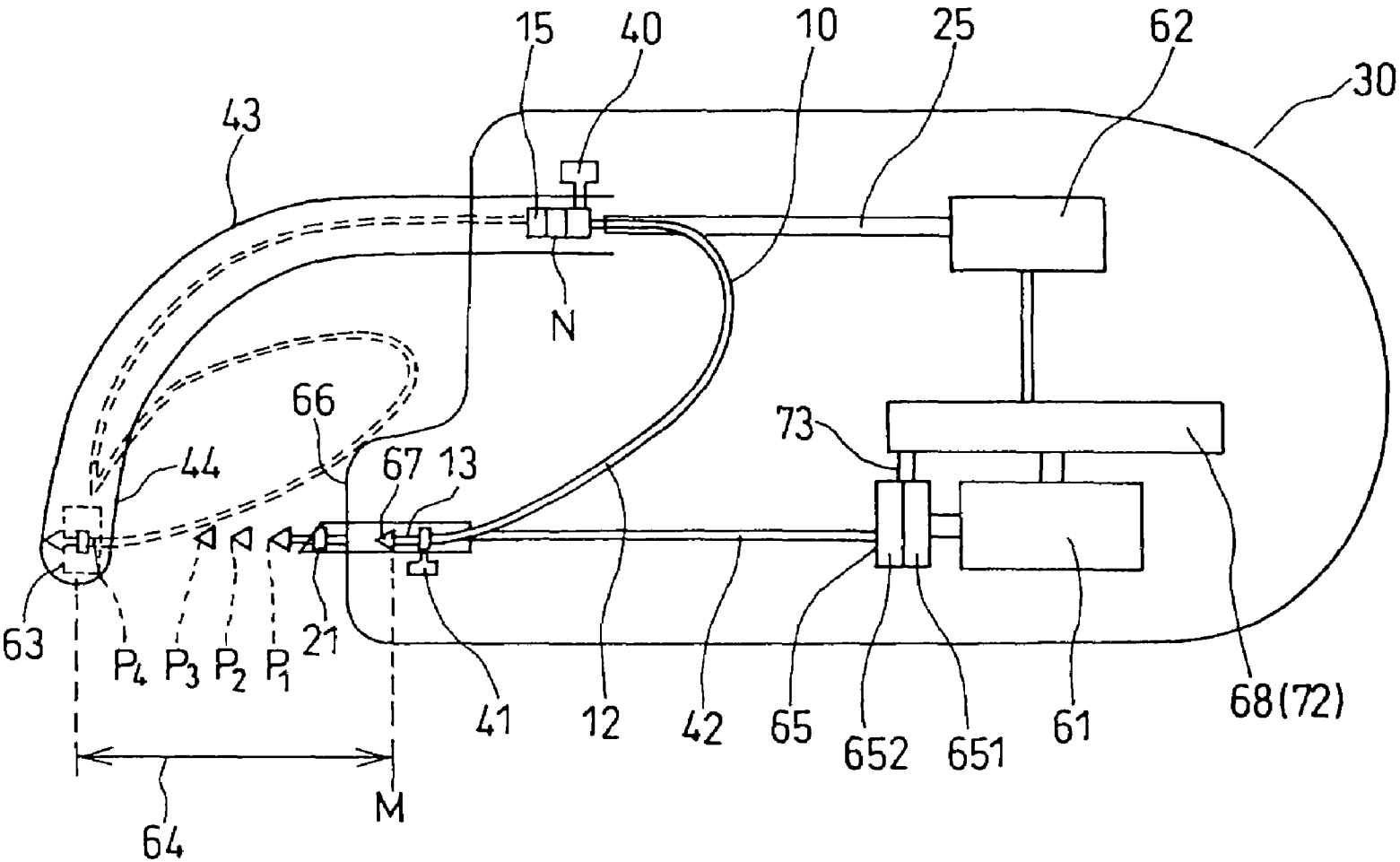
FIG. 1 is a plan view showing the general construction of a specific example of a loop pin connecting device according to the present invention.

FIG. 1 is a plan view showing the configuration of an example of a loop pin connecting device according to the present invention. The loop pin connecting device 30 shown in this drawing shoots out a loop pin 10, which has a flexible filament 12, an insertion head portion 13 having an appropriate mating part 16 provided on one end of the filament 12, and a socket portion 15 having a hole 14 on the other end of the filament 12 for irreversibly passing the insertion head portion of the filament 12, so that the insertion head portion 13 mates into the socket portion 15, thereby forming a loop-shaped holder. The loop pin connecting device 30 further has a first feeding means 61, which feeds out the insertion head portion 13 toward the front of the loop pin connecting device 30 and a second feeding means 62, which feeds out the socket portion 15 toward the front of the loop pin connecting device 30, for the purpose of causing mutual mating therebetween, wherein during one stroke 64 from a position at which the insertion head portion 13 and the socket portion 15 of the individual loop pins 10 are set into the loop pin connecting device 30 such that the insertion head portion and socket portion are moved up to a position 63 at which there is mutual mating therebetween, at least the first feeding means 61 has a feeding operation interruption mechanism 65 that is capable of temporarily stopping the feeding operation of the first feeding means 61 at an arbitrary position during the stroke.

Figure 2:
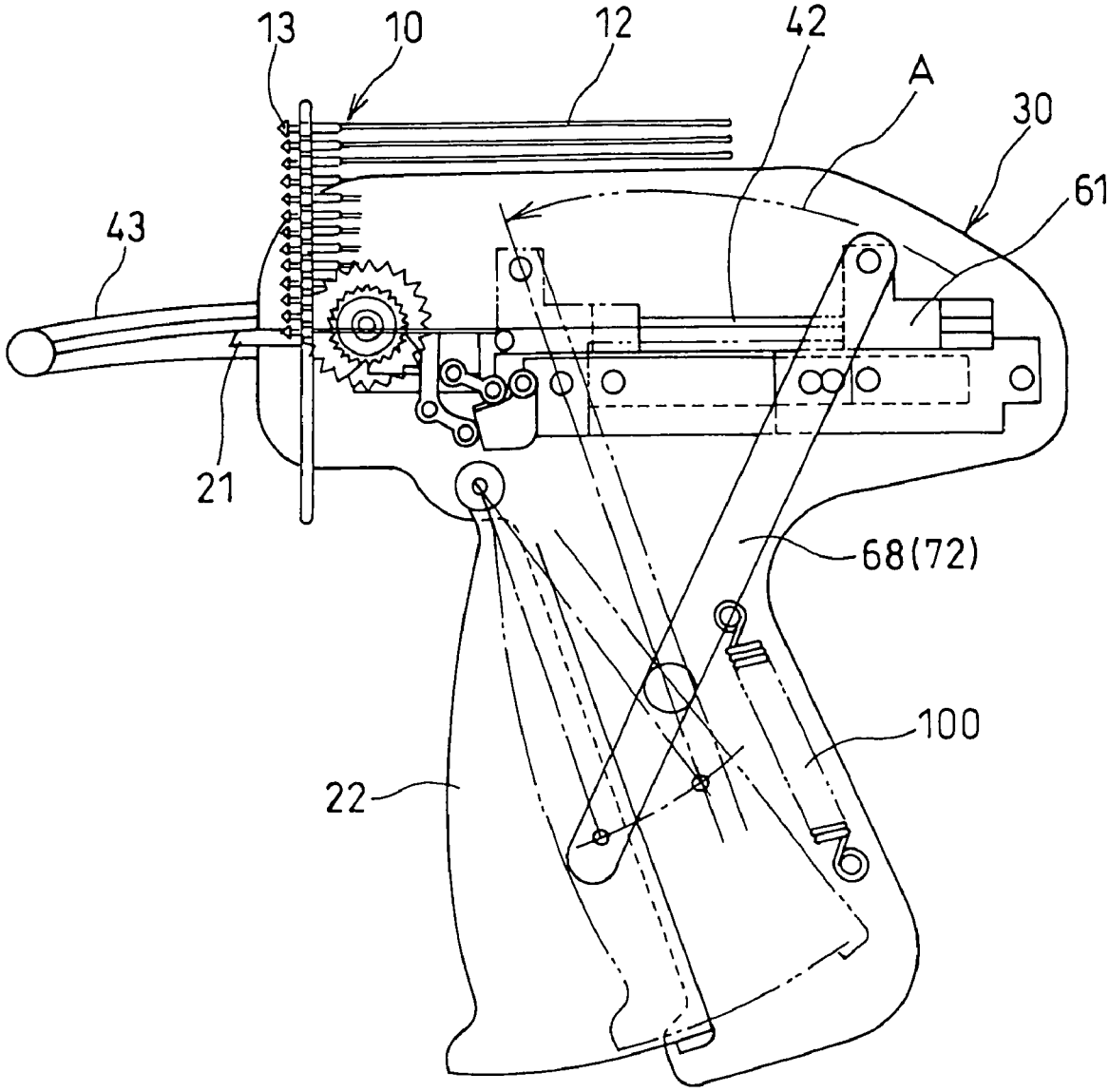
FIG. 2 is a side elevation showing the general construction of a specific example of a loop pin connecting device according to the present invention.
Figure 3:
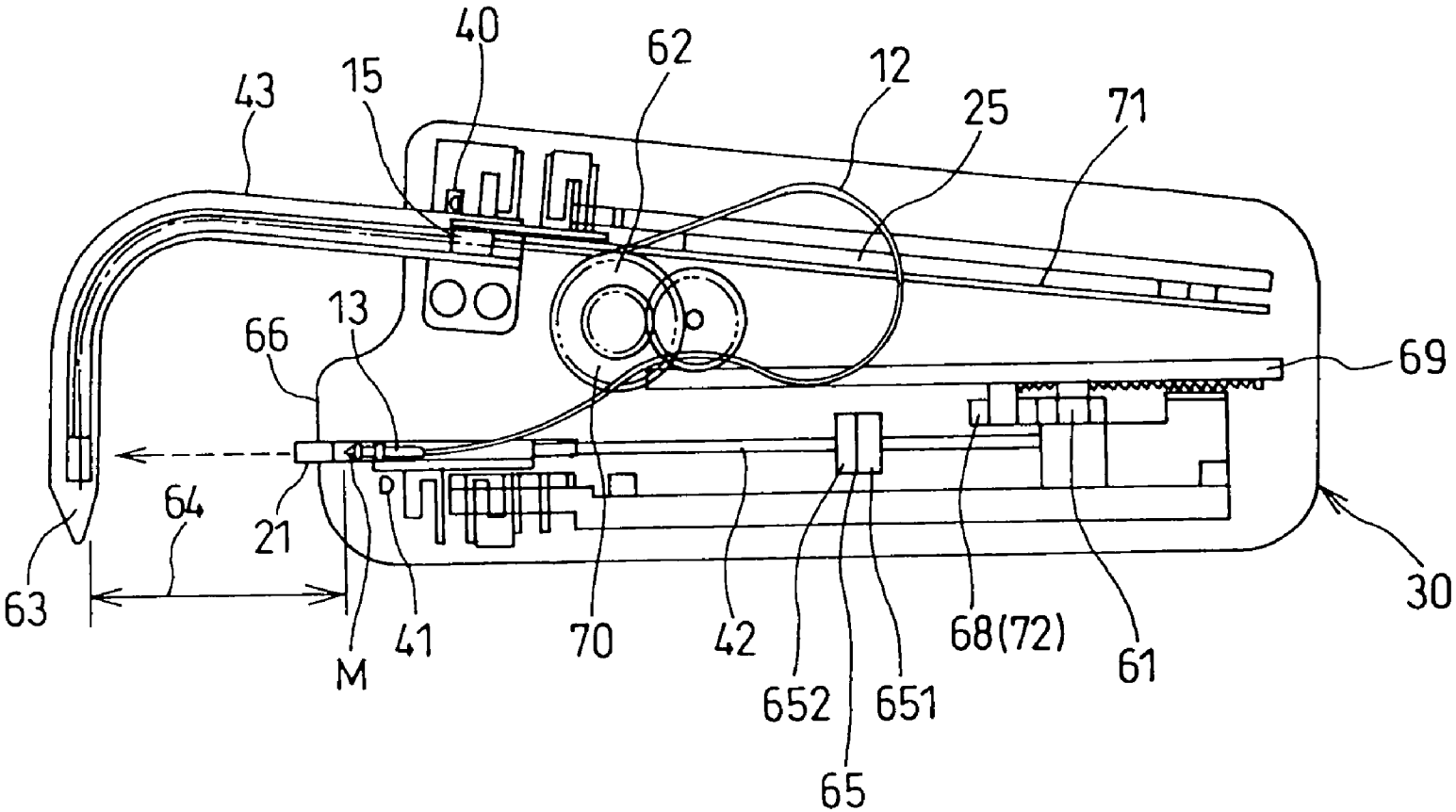
FIG. 3 is a plan view showing details of the construction of another specific example of a loop pin connecting device according to the present invention.
Figure 4:
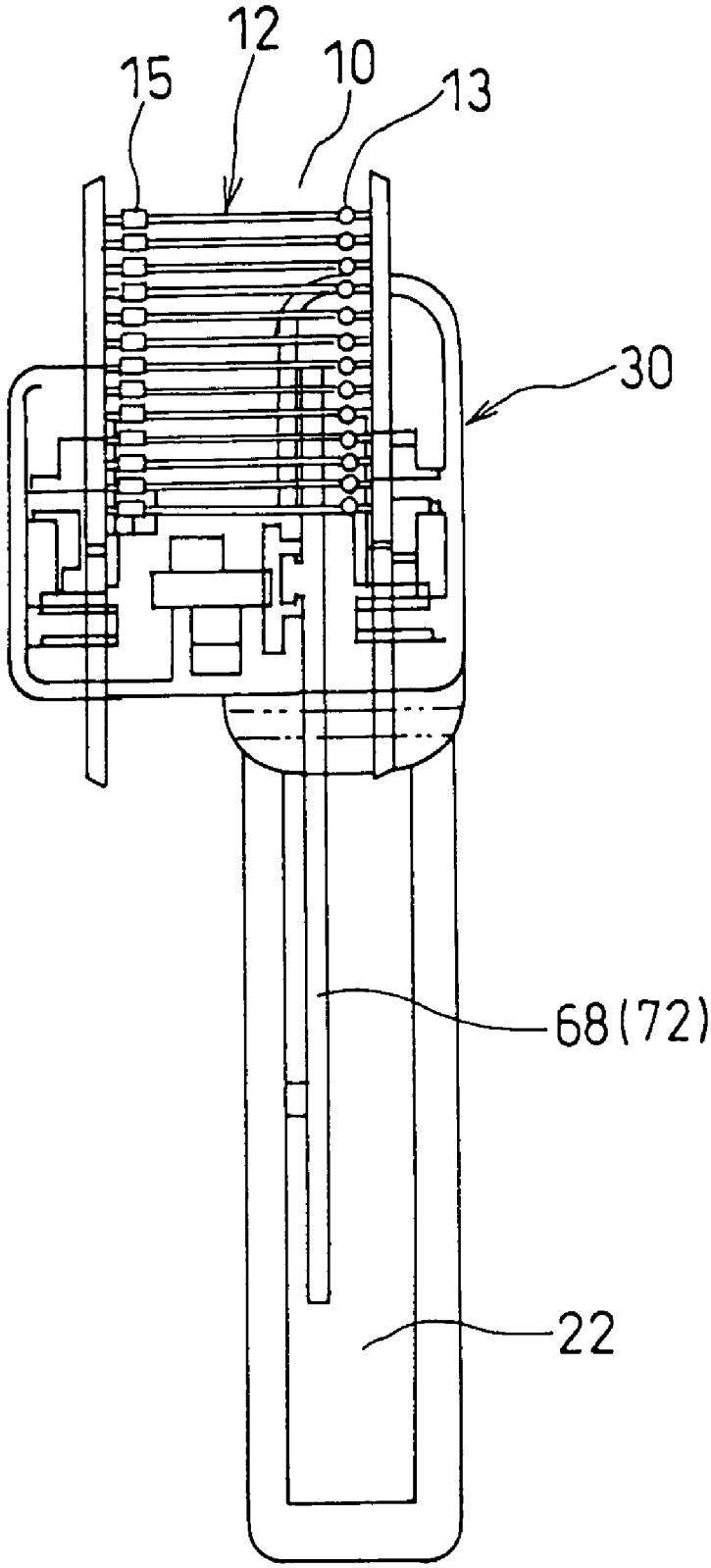
FIG. 4 is a front elevation generally showing the construction of another example of the loop pin connecting device according to the present invention shown in FIG. 2.

FIG. 2 is a side elevation showing the above-noted loop pin connecting device 30 according to the present invention, this drawing showing an example of a drive mechanism for the purpose of driving the first feeding means 61 and the second feeding means 62. FIG. 3 is a front view showing the loop pin connecting device 30 according to the present invention, onto which a prescribed loop pin sheet 600 is mounted.

The feeding operation interruption mechanism 65 in the present invention is configured so that the feeding operation of the insertion head portion 13 is caused to stop at a first interruption position P1, which is between the loop pin feeding surface 66 of the loop pin connecting device 30 and the mating position 63 at which the insertion head portion 13 and the socket portion 15 mutually mate at the front of the loop pin connecting device 30 and at which the tip end part 67 of the insertion head portion 13 is closer to the loop pin feeding surface 66 than to the mating position 66.

It is preferable that the feeding operation interruption mechanism 65 for the purpose of interrupting the feeding operation of the insertion head portion 13 of the loop pin 10 in the present invention be configured so that the feeding operation of the insertion head portion 13 is caused to stop at a second interruption position P4, which is formed between the loop pin feeding surface 66 of the loop pin connecting device 30 and the mating position 63 at which the insertion head portion 13 and the socket portion 15 mutually mate at the front of the loop pin connecting device 30, and at which is close to the position at which the tip end part 67 of the insertion head portion 13 is in close proximity to the mating position 63.

The first interruption position P1 is established so that the tip end part 67 of the insertion head portion 13 protruding from loop pin feeding surface 66 of the loop pin connecting device 30 is at a position that enables easy insertion into an opening or small hole in product to which the loop pin 10 is to be mated by passing the loop pin therethrough.

Specifically, the present invention is particularly intended for use in passing a loop pin 10 through a buttonhole of a shirt, a small hole of a zipper pull-grip, a shoestring hole of a shoe, or a ring at the end of the strap that wraps around an umbrella, so as to attach a tag or the like to a small hole, enabling an insertion operation in this application that was in the past almost always done by an operator to be performed with good efficiency using a gun, which is the loop pin connecting device of the present invention.

To that purpose, specifically in the loop pin connecting device 30, a hollow guide 21 through which the insertion head portion 13, which has been used in the past, is made as short as possible and, having done this, during one stroke 64 causing movement of the insertion head portion 13 to the position 63 at which there is mutual mating with the socket portion 15, there is at least a temporary interruption of the forward operation of at least the tip end part 67 of the insertion head portion 13 at an arbitrary position (P1, P2, or P3) in the one stroke, so as to fix the tip end part 67 at that position.

In the present invention, the tip end part 67 of the insertion head portion 13 that has been held fixed at a position protruding from the front surface 66 of the loop pin connecting device 30 is first inserted into, for example, a buttonhole of a shirt, after which the first feeding means 61 is restarted, so as to cause mating between the insertion head portion 13 and the socket portion 15, thereby completing a loop-shaped loop pin that holds a label or the like via the buttonhole of the shirt.

In the present invention, therefore, in contrast to the situation in the past, in which there was a risk of damaging the surface of a product by the hollow pin 21, which was made of metal or the like, because the configuration is one in which a plastic head part 67 of the insertion head portion 13 is passed through the hold in the product, even if the hollow guide 21 is made of metal there is the effect of completely eliminating the danger of damaging the surface of the product.

Additionally, it is possible in the present invention to eliminate the hollow guide 21.

For the above-noted reason, in the present invention it is necessary to set the stopping position of the tip end part 67 of the insertion head portion 13 at the length that is the most appropriate for the position of attaching the label or the like to the target product, meaning that it is necessary to set the stopping position of the tip end part 67 of the insertion head portion 13 appropriately so that it is at a length that makes it easy to pass the insertion head portion 13 through the target product.

Additionally, there is no need for the stopping position of the tip end part 67 of the insertion head portion 13 in a given single loop pin connecting device 30 to be a single position, it being possible, for example as shown in FIG. 1, to have a plurality of positions (P1, P2, and P3).

Specifically, it is preferable in the present invention that the first interruption position P1, P2, or P3 be freely adjustable as distances from the loop pin feeding out surface 66 in the loop pin connecting device 30, and additionally preferable that a plurality of first interruption positions be provided within the one stroke 64.

The loop pin connecting device 30 is configured so that at the first interruption position P1, P2, or P3 in the present invention, in the case in which the operator attempts to pass the insertion part of the insertion head portion 13 of the loop pin 10 through a prescribed small hole in the product and temporarily holds the insertion head portion 13 in the stopped condition at the first interruption position, the operation lever 22 of the loop pin connecting device 30 goes into the loose condition, and there is no change in the stopped position of the insertion head portion 13 even if the operator releases the hand from the operation lever 22.

A more specific example of a loop pin connecting device 30 according to the present invention is described below, with references made to FIG. 2 and FIG. 3.

In these drawings, when the operator operates the operation lever 22 of the loop pin connecting device 30, the first feeding means 61 engaged with the tracking lever 68 linked to the operation lever 22 and which swings in the direction of the arrow A moves horizontally to the left in FIG. 2 so that the out-pushing pin 42 mated with the end of the first feeding means 61 is pushed outward horizontally toward the left, causing the insertion head portion 13, which is in contact with the end of the out-pushing pin 42 to be pushed outward toward the mating position 63 via the hollow pin 21.

Along with the above, synchronized with the movement of the movable rack 69 engaged with the first feeding means 61 toward the left, the rotating gear group 70 rotates, so that the out-pushing pin 25 comprising a rack mechanism 71 linked to the rotating gear group 70 moves toward the left, resulting in the socket portion 15, which is in contact with the end part of the out-pushing pin 25 sliding within the guide member 43 as it moves to the mating position 63, at which position it mates with the insertion head portion 13.

In the above-noted specific example, the rack 69, the rotating gear group 70, and the out-pushing pin 25 form the second feeding means 62 of the present invention.

In the present invention, the above-noted feeding operation interruption mechanism 65 is disposed in proximity to the first feeding means 61.

In the present invention, as described above, the feeding operation interruption mechanism 65 is configured so that operation of feeding the insertion head portion 13 is interrupted at the second interruption position P4, which is between the loop pin feeding surface 66 of the loop pin connecting device 30 and the mating position 63 at the front of the loop pin connecting device 30 for the purpose of mutual mating between the insertion head portion 13 and the socket portion 15, and at which position the tip end part 67 of the insertion head portion 13 is in proximity to the mating position 63.

That is, it is preferable that the second interruption position P4 in the present invention be a position corresponding to a position in which the insertion head portion 13 and the socket portion 15 are either not in the mated condition or are in an incompletely mated condition.

Specifically, the condition in which there is no mating or incomplete mating between the insertion head portion 13 and the socket portion 15 often occurs for the reasons described above, and even if it often happens that the operator is usually not aware of this unmated or incompletely mated condition and, even if the operator is aware of the condition, the operator often simply presses the operation lever once again, thereby resulting in tangling of the newly shot out loop pin with the previously shot out loop pin, not only creating a jammed condition, but also making it necessary to perform the troublesome task of removing the improperly mated loop pin from the loop pin connecting device 30.

For this reason, in the present invention, rather than pulling the operation lever 22 to its final position, if the operation of the operation interruption mechanism is set so that the end part of the insertion head portion 13 is stopped at a position at which there is a great probability of the occurrence of non-mating or incomplete mating of the tip end part 67 of the insertion head portion 13 often caused by the fact that the operation lever has not been pulled completely, the first feeding means 61 never returning to its original position, and the first feeding means 61 and the second feeding means 62 are temporarily stopped.

In this condition, because the operation lever 22 is in the loose condition, the operator can verify the occurrence of the non-mated or incompletely mated condition.

By continuing the pulling of the operation lever 22 to the final position, it is possible, without the next loop pin being shot out, to execute only the remainder of the operation in the stroke of the loop pin that is non-mated or incompletely mated, so that the insertion head portion 13 is caused to reliably mate within the socket portion 15.

As is clear from the above description of the present invention, the operation interruption mechanism 65 of the present invention must be configured so as to be able to stop the insertion head portion 13 at one of the interruption positions P1 through P4 when the feed operation for the insertion head portion 13 is stopped, and furthermore the feeding operation interruption mechanism 65 must be configured so that, at the first or second interruption position, after the feeding operation of the insertion head portion 13 is stopped, the completion of the remainder of the one stroke 64 is allowed after the interruption operation.

In the present invention, it is further desirable that there be a function which, in the case in which the insertion head portion 13 is stopped at the second interruption position, notifies the operator of the condition in which there is non-mating or incomplete mating between the insertion head portion 13 and the socket portion 15.

This notification function can be, for example, placing the operation lever 22 into the loose condition, the sounding of a buzzer, or the change of color information indicated on a separately provided display apparatus.

It is desirable in the present invention that the feeding operation interruption mechanism 65 be configured so that, even if the feeding operation of the insertion head portion 13 is caused to stop at either the first or second interruption position, there is no reverse movement with respect to the feeding out direction.

It is also preferable that the feeding operation interruption mechanism 65 used in a loop pin connecting device 30 according to the present invention have a first interruption mechanism 651 for controlling the first interruption mechanism and a second interruption mechanism 652 for controlling the second interruption mechanism.

The first feeding means 61 and the second feeding means 62 of the present invention are configured so that, they are driven, either directly or indirectly by a feeding means driving mechanism 72, which is made up of, for example, the operation lever 22 and the tracking lever 68 or a motorized mechanism (not illustrated) via an appropriate member.

In addition, it is desirable in the present invention that either one or both of the first interruption mechanism 651 and second interruption mechanism 652 be effective during the one stroke 64 in the feeding operation of the insertion head portion 13.

The basic configuration of above-described loop pin connecting device 30 according to the present invention can be applied as well to a loop pin connecting device such as disclosed in the Japanese Patent Laid-Open Patent Application 2001-354218 (patent reference 1).

The specific configuration of the operation interruption mechanism 65 of the present invention is described in detail below.

Figure 5:
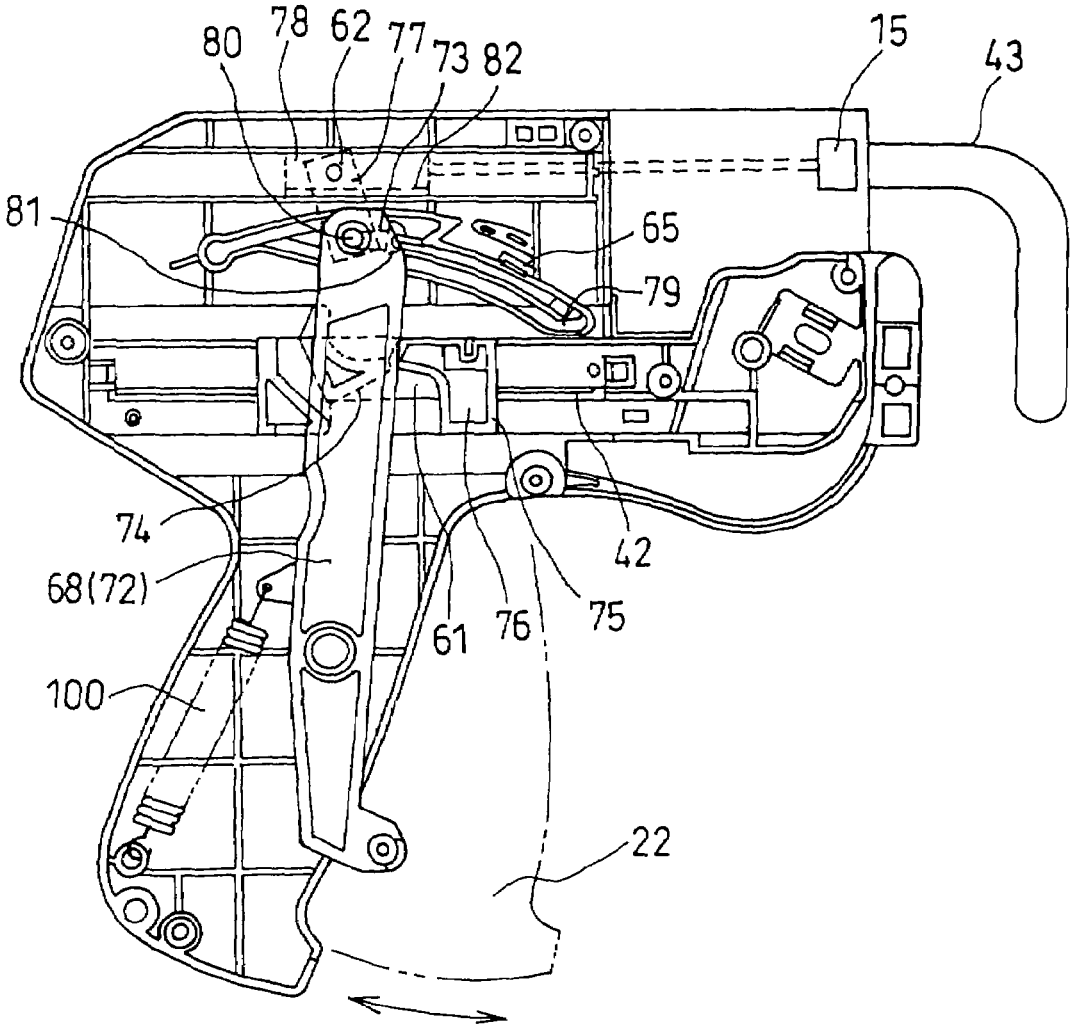
FIG. 5 is a side elevation showing the general construction of a first feeding means and feeding operation interruption mechanism in another specific example of a loop pin connecting device according to the present invention.
Figure 5:
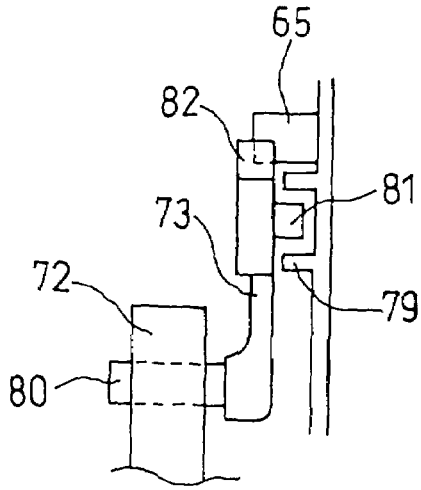

Specifically, FIG. 5 shows an example in which the operation interruption mechanism of the present invention is applied to a loop pin connecting device as disclosed in the Japanese Patent Unexamined Patent Publication (KOKAI) No. 2001-354218 (patent reference 1), this drawing illustrating the internal configuration at the side of the loop pin connecting device 30.

Specifically, a guide member 73 is provided on a part of the feeding means driving mechanism 72 (that is, the tracking lever 68) that drives at least the first feeding means 61, and part of this guide member 73 is provided with part of an operation interruption mechanism.

In this specific example, the guide member 73 is provided on the end of the feeding means driving mechanism 72 consisting the tracking lever 68 and swingably mounted on a rotating shaft 80.

The guide member 73 is further provided with a protrusion 81, which mates with a guiding track 79 that forms a part of the feeding operation interruption mechanism 65, and a ratchet 82 that is made of a pawl or the like that forms part of the feeding operation interruption mechanism 65.

The first feeding means 61 in this specific example is formed by a cam 74 provided on the feeding means driving mechanism 72 and a control cam 76 provided on a first slider 75 which is connected to the out pushing pin 42 and can slide right and left direction.

The second feeding means 62 in the present invention is formed by, as shown by the broken line in FIG. 5, is formed by a second slider 78 having an out-pushing pin 25 connected to a link 77 that is swingably connected to the feeding means driving mechanism 72.

In this specific example, therefore, by the operation of the operation lever 22 the feeding means driving mechanism 72 formed by the tracking lever 68 swings, and the rightward sliding (in the drawing) of the first feeding means 61 and the second feeding means 62 cause the insertion head portion 13 and the socket portion 15 to simultaneously by shot out of the loop pin connecting device 30.

Figure 6:
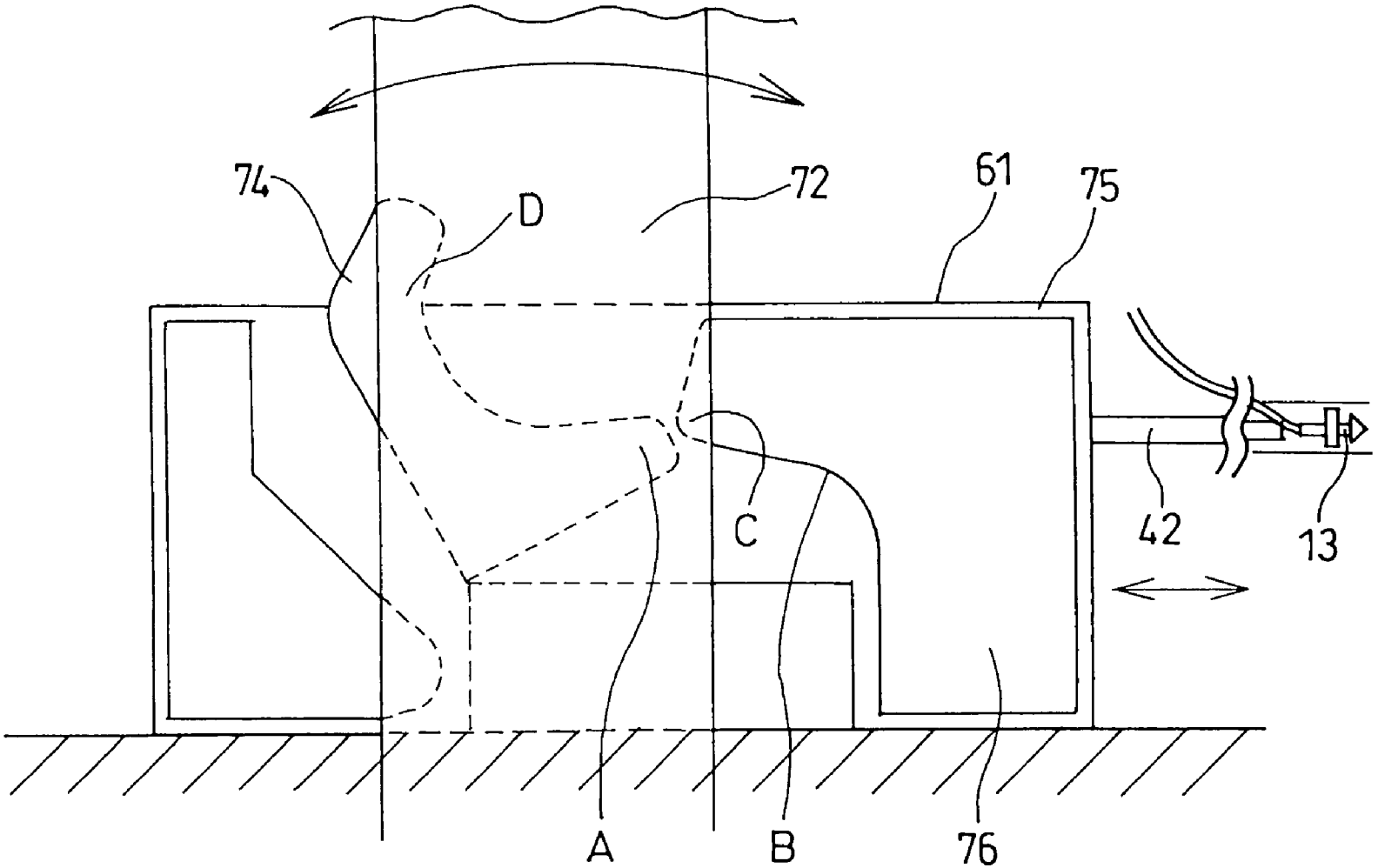
FIG. 6 is a drawing showing the configuration of a specific example of a first feeding means used in the same loop pin connecting device of the present invention.
Figure 7:
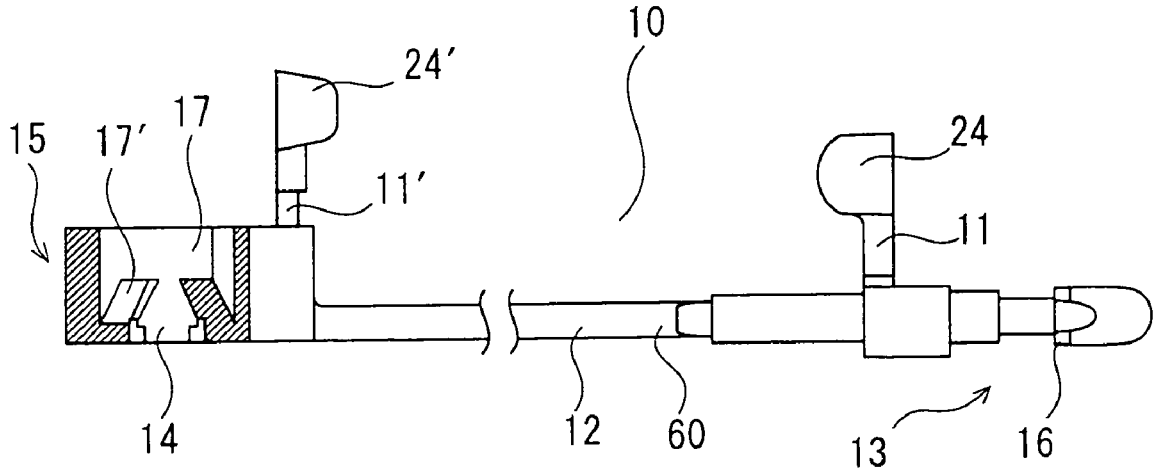
FIG. 7 is a drawing showing the configuration of a specific example of a loop pin used in the present invention.
Figure 8:
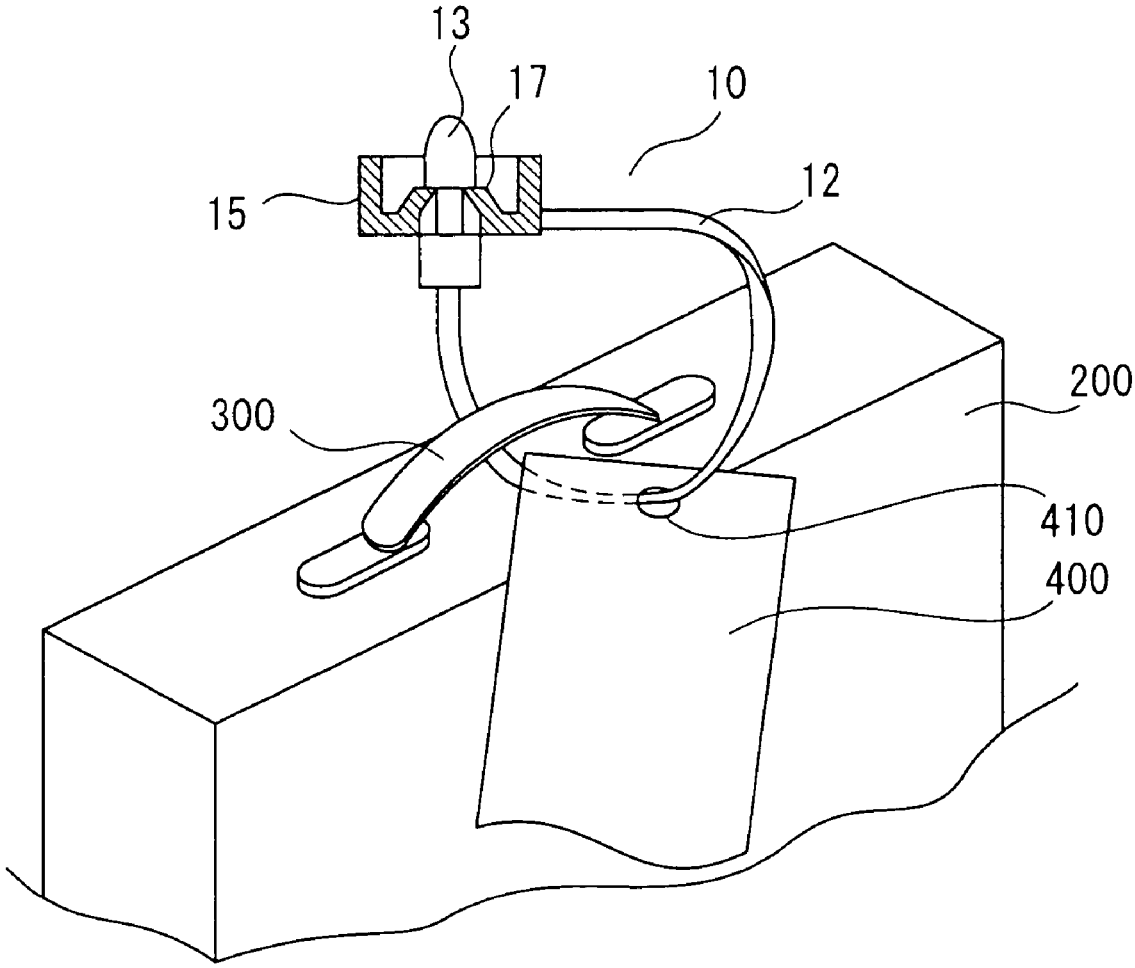
FIG. 8 is a drawing illustrating the condition of use of the loop pin of FIG. 7.
Figure 9:
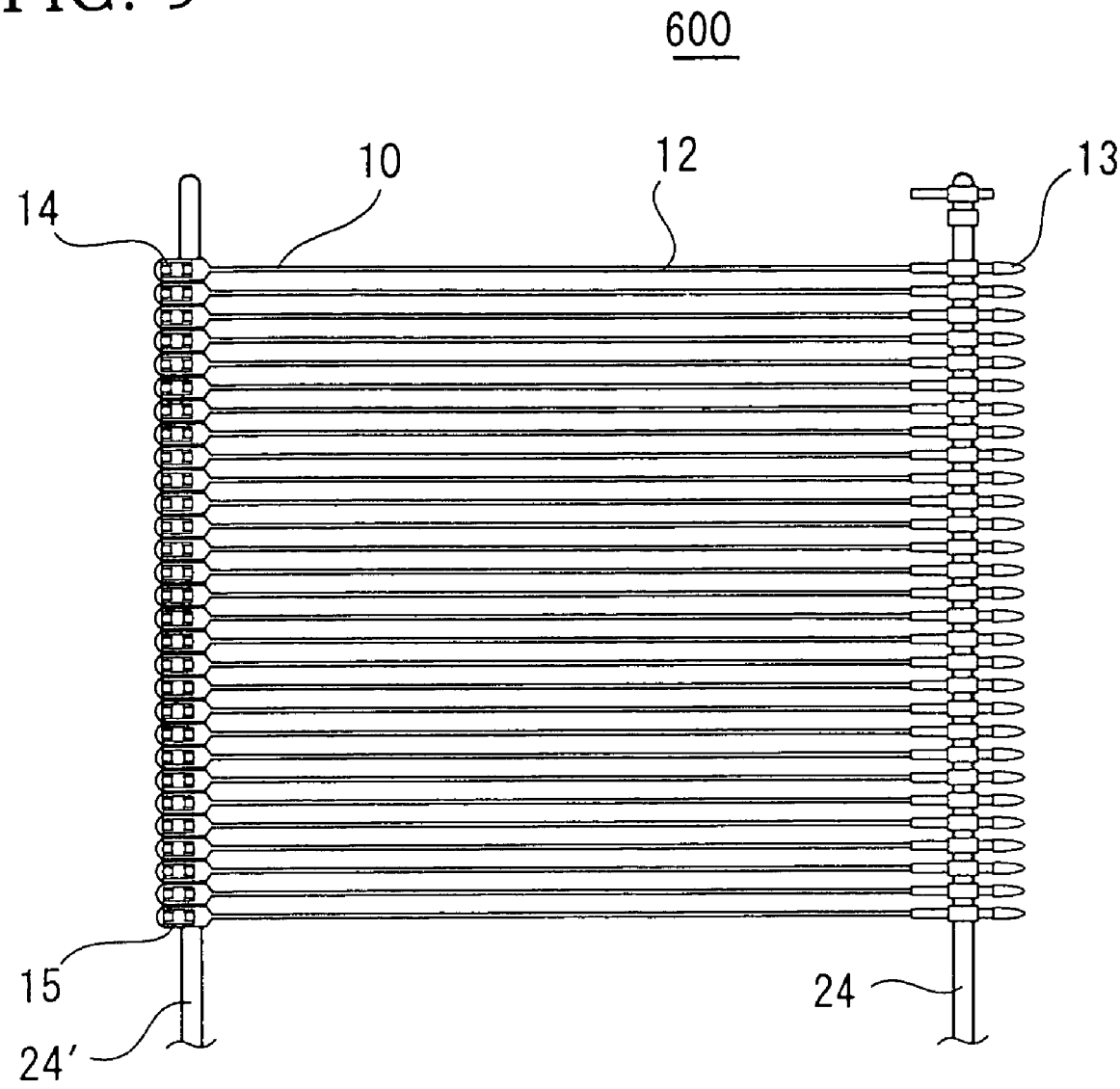
FIG. 9 is a drawing showing an example of the configuration of a group of loop pins of FIG. 6 linked together in the present invention.
Figure 10:
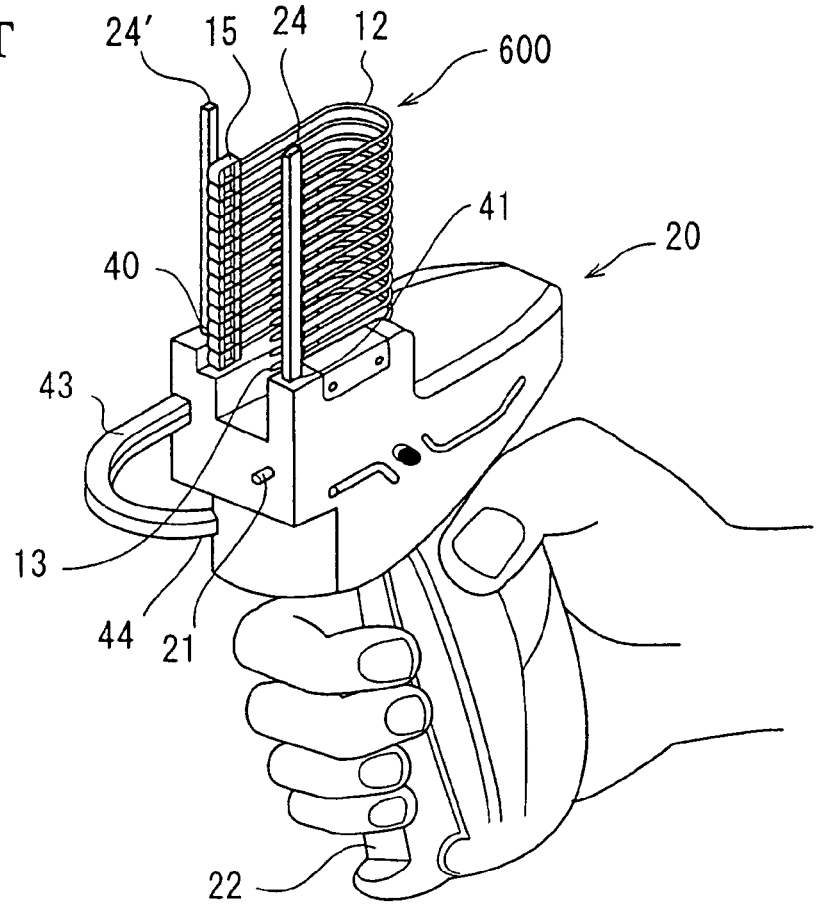
FIG. 10 PRIOR ART
FIG. 10 is a drawing showing the configuration of a loop pin connecting device of the past.
Figure 11:
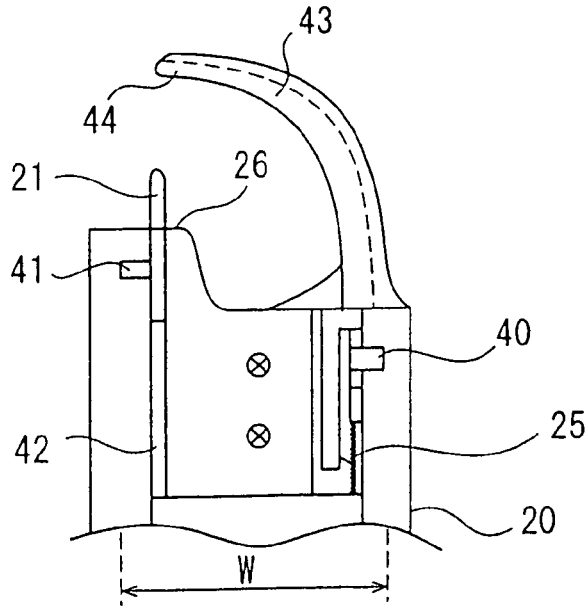
FIG. 11 PRIOR ART
FIG. 11 is a plan view showing the loop pin connecting device of the past shown in FIG. 10.
Figure 12:
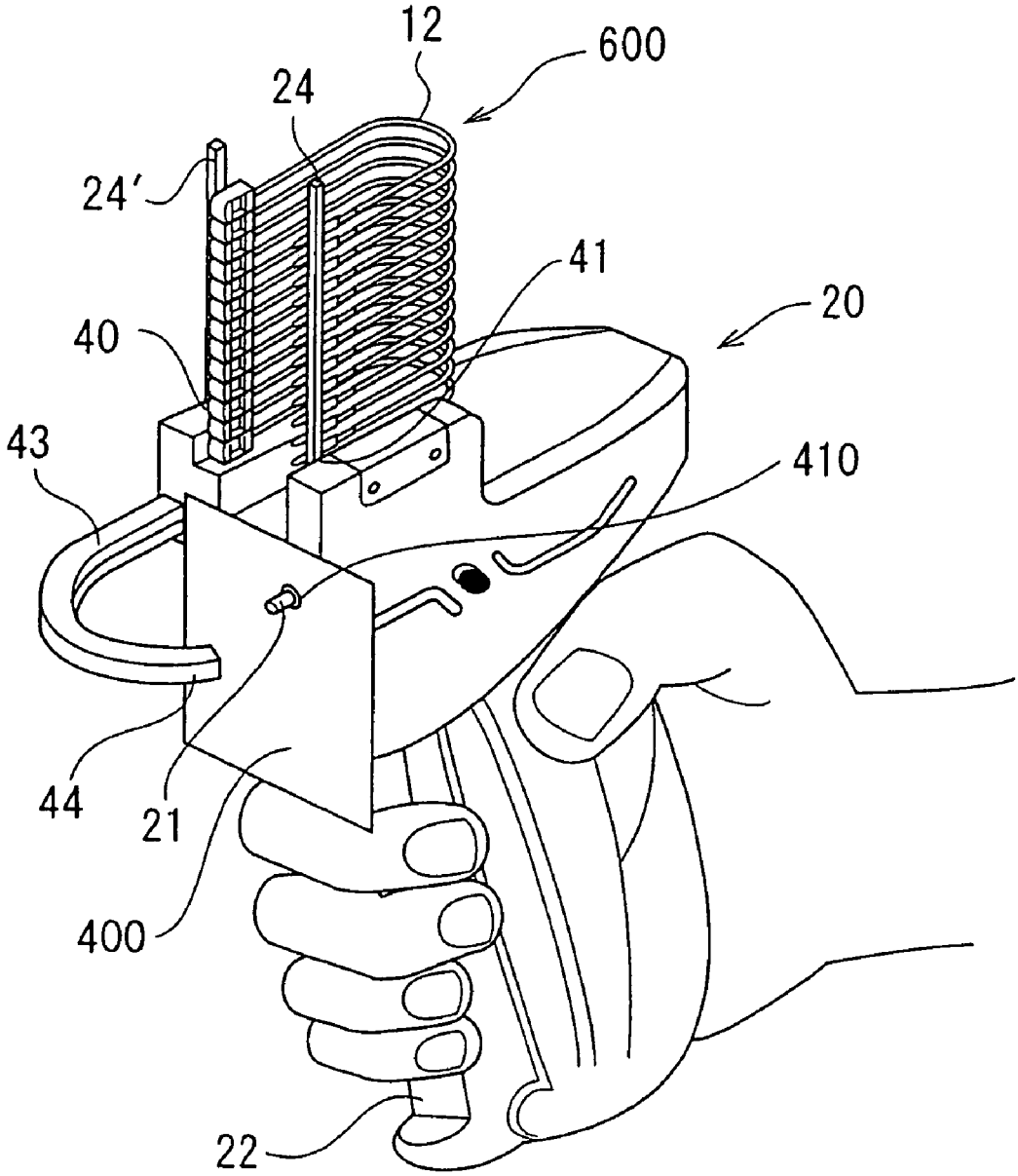
FIG. 12 PRIOR ART
FIG. 12 is a drawing showing an example of using the loop pin connecting device of the past shown in FIG. 10.

It is desirable in the loop pin connecting device 30 that a time delay be provided so that after the second out-pushing pin reaches the end part of the guide member, it waits for a given amount of time, after which the first out-pushing pin reaches the end part of the guide member. For that purpose, in this example, as shown in FIG. 6, although the second feeding means 62 starts sliding rightwards simultaneously with the right turning of the tracking lever 68, with regard to the first feeding means 61, when the operation lever 22 is operated, the tracking lever 68 first turns rightward and, without coming into contact with the end part (A) of the cam 74 provided on the tracking lever 68 and the end part (C) of the control cam 76 provided on the first slider 75, the end part (A) of the cam 74 only slides along the curved portion (B) formed on the control cam 76. Because of this, because the control cam 76 does not move toward the right during this time, the first feeding means 61 is maintained in the stopped condition. At the point at which the rear curved portion (D) of the cam 74 comes into contact with the end part (C) of the control cam 76, the control cam 76 moves toward the right, resulting in the first feeding means 61 starting its operation a prescribed amount of time after the start of the operation of the second feeding means 62.

The feeding operation interruption mechanism 65 of the present invention is formed on an inner wall surface of the loop pin connecting device 30, for example as shown in FIG. 5, by a guiding track 79 formed in proximity to the guide member 73 along the guide member 73 provided on the feeding means driving mechanism that drives the feeding means.

As described above, the guide member 73 is provided with a guiding track 79 and either a guiding track mating member 81 formed by a protruding part 85 that slides along the guiding track 79 or a guiding track mating member 81 formed by a depression 86.

Figure 14:
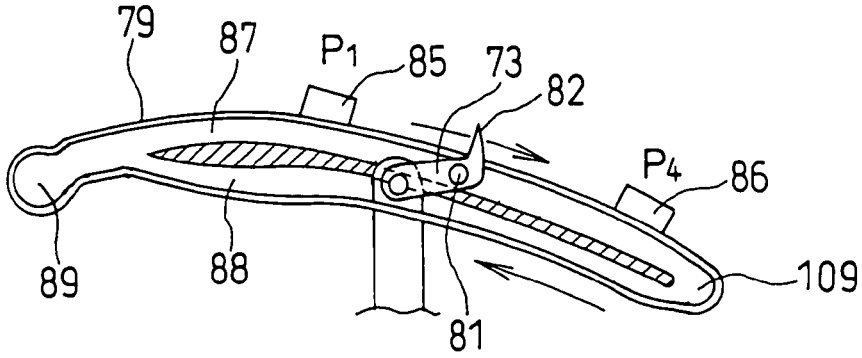
FIG. 14 is a drawing showing an example of the configuration of a guiding track using in a loop pin connecting device according to the present invention.
Figure 14:
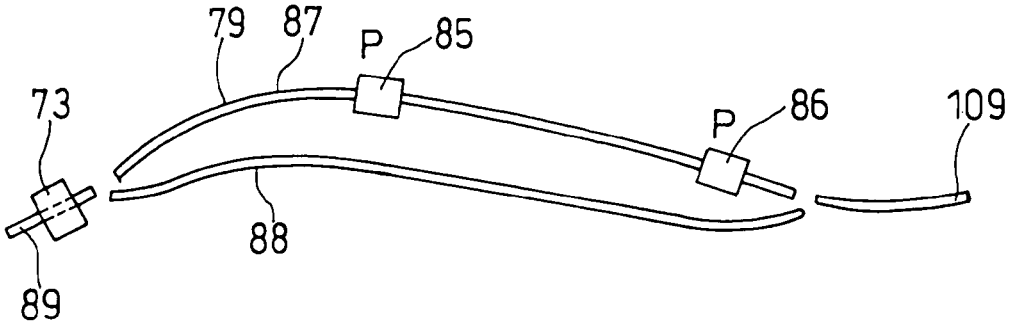
Figure 14:
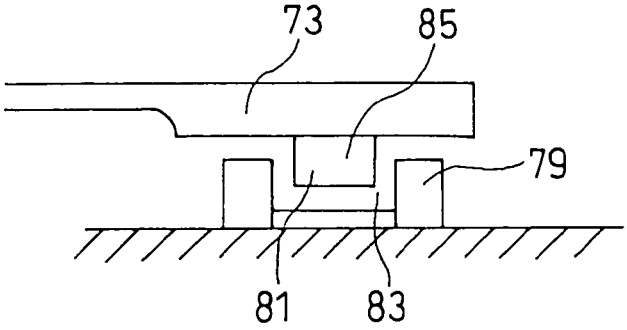
Figure 14:
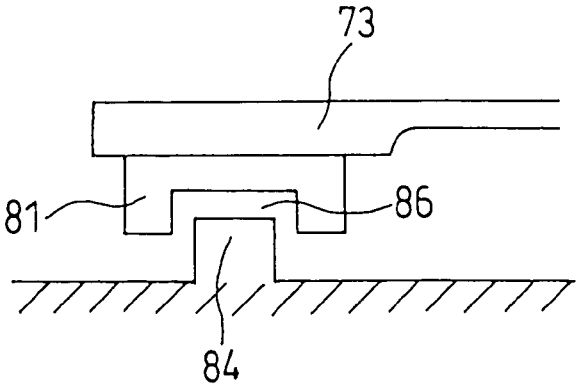

It is desirable that the guiding track 79, as shown in FIG. 14, have either a long groove part 83 or a long protrusion part 84 formed in the inner wall of the loop pin connecting device 30.

It is desirable that the guiding track mating member 81 in the present invention have a structure enabling it to mate inside the groove 83 of the guiding track 79 or mate with the protrusion part 84, and also that the guiding track mating member 81 be configured so that it is capable of sliding within the groove 83 or along the protrusion part 84.

Figure 13:
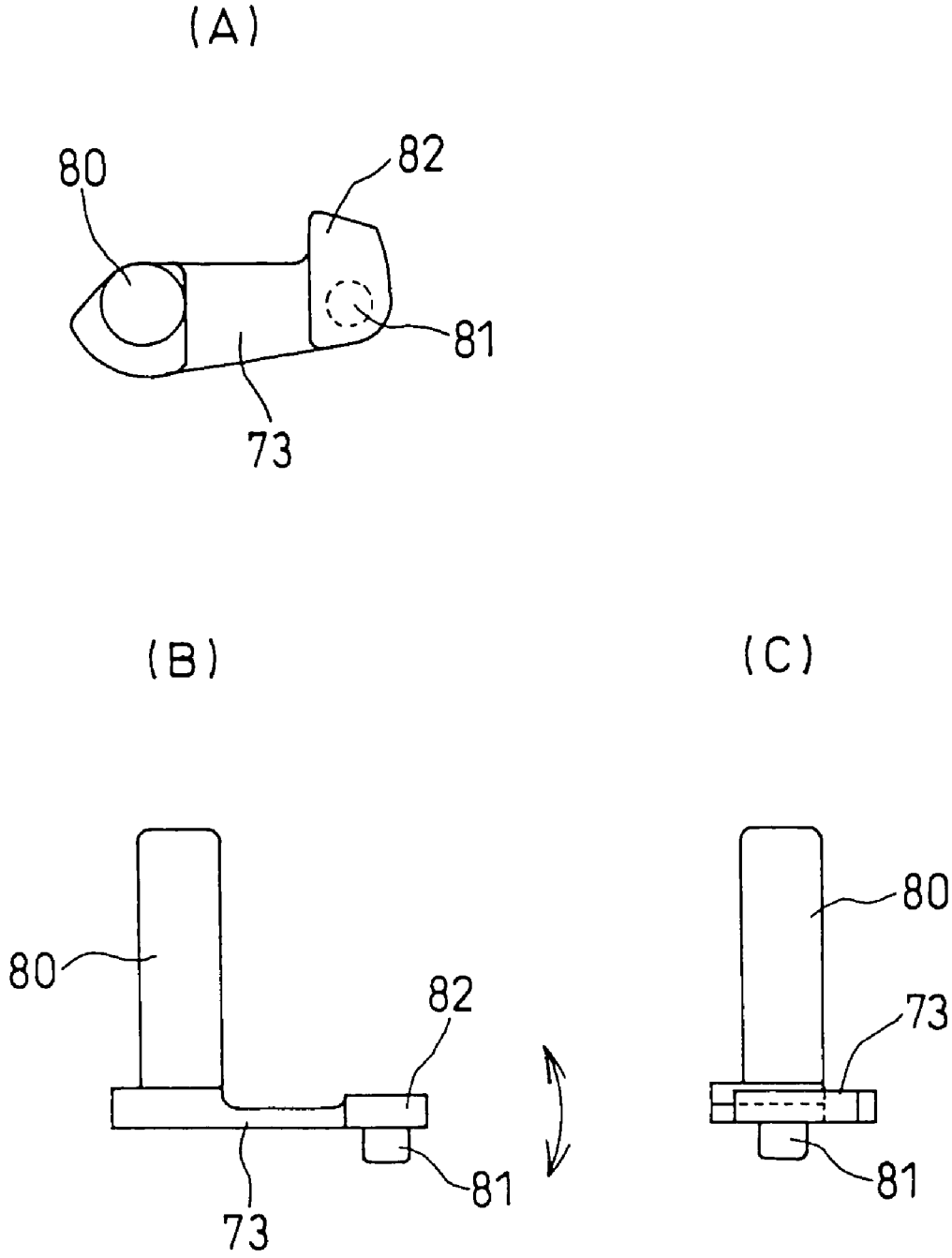
FIG. 13 is a drawing showing an example of the configuration of a guide member used in the present invention.

Additionally, in the present invention, as shown in FIG. 13, is further provided with a holding pawl 82 that makes up part of the ratchet 82 on part of the guide member 73 provided in the first feeding means 61, this holding pawl 82 or the like forming a stopper means and also forming the operation interruption mechanism 65 of the present invention.

Furthermore, because the tracking lever 68, which is the feeding means driving mechanism 72 of the present invention, as shown in FIG. 5, has applied thereto by an appropriate spring 100 a bias force by which the end part thereof, with which the guide member 73 is mated, constantly attempts to return leftward, both the first and the second feeding means 61 and 62 receive a bias force that enables them to move toward the left in FIG. 5.

In a specific example of the loop pin connecting device 30 according to the present invention shown in FIG. 14(A), which is an example in which the guiding track 79 is formed by a groove 83, within which the guiding track mating member 81 mates and slides along, in addition to disposing an appropriate stopper member 85 at a position corresponding to the first interruption position P1 near the outer periphery of the guiding track 79, an appropriate stopper member 86 is disposed at a position corresponding to the second interruption position P4.

Accompanying movement of the first feeding means 61, the protrusion part 85 of the guiding track mating member 81 provided in the guide member 73 slides along the groove 83 and, when it reaches the first interruption position P1, by the operator intentionally letting up on the pressure on the operation lever 22, the pawl or ratchet 82 provided on the guiding track mating member 81 engages with the stopper member 85, so that return movement of the first feeding means 61 is blocked, resulting in the insertion head portion 13 being held in the stopped condition at the first interruption position P1.

During this time, as noted above, the operator performs an operation of inserting the insertion head portion 13 of the loop pin 10, which protrudes from the front surface of the loop pin connecting device 30, through the required small hole of the prescribed product, after which the operator resumes the forward operation of the first feeding means 61, so as to execute the remainder of the stroke and, in the case in which there is already complete mating between the insertion head portion 13 and the socket portion 15, the operation of shooting out the loop pin 10 is completed, at which point the looped loop pin 10 is removed from the loop pin connecting device 30 to complete the operation of one stroke.

If, however, it was not possible to complete the operation of the operation lever 22 to the final position, and there is either no mating or only incomplete mating between the insertion head portion 13 and the socket portion 15, if the operator lets up only a small amount on the pressure applied to the operation lever 22, the pawl or ratchet 82 provided on the guiding track mating member 81 immediately mates with the stopper member 86, so that reverse movement of the first feeding means 61 is blocked, thereby causing the insertion head portion 13 to be held in the stopped condition at the second interruption position P4.

After the above, after the operator recognizes the condition in which there is no mating or incomplete mating in the loop pin 10, by pulling the operation lever 22 further to the final position, the forward operation of the first feeding means 61 is resumed, so that the remainder of the operation for the stroke is performed and, in the case in which there is complete mating between the insertion head portion 13 and the socket portion 15, this completes the operation of shooing out the loop pin 10, at which point the looped loop pin 10 is removed from the loop pin connecting device 30, thereby completing the one stroke operation.

After the above, when the operation lever 22 is released, the guiding track mating member 81 of the guide member 73 moves along a second guiding track 88, which is a groove for returning formed separately from the first guiding track 87 that is the groove for the forward movement, moving in the direction opposite the feeding operation direction of the first feeding means 61, to return to the starting position 89, thereby preparing for the shooting out of the next loop pin.

It is desirable, therefore, that the guiding track 79 in this example be in the shape of a closed loop.

Figure 15:
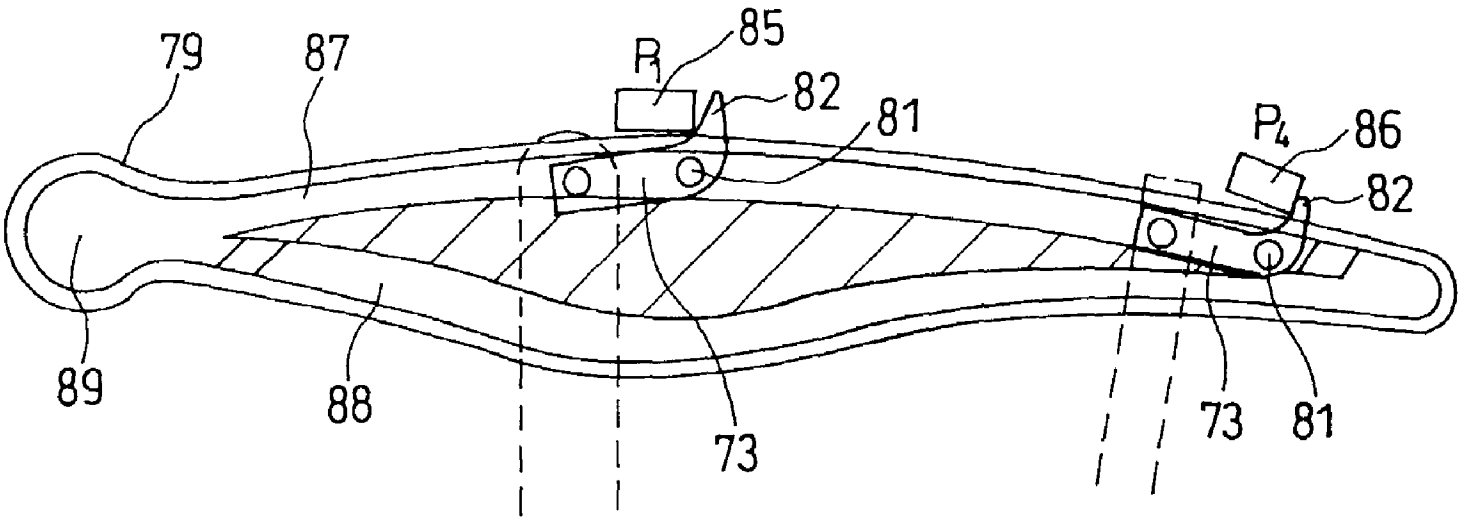
FIG. 15 is a drawing illustrating the mating condition between the guiding track mating member and the stopper in the guiding track.

In this specific example, as shown in FIG. 15, the configuration is made such that the holding pawl 82 provided on the guide member 73 has constantly applied to it a bias force in the upward direction as shown in FIG. 15, so that when passing the bottom parts of the stoppers 85 and 86, it is possible to move downward.

In another specific example of the present invention, the stoppers 85 and 86 as shown in FIG. 16(A) are formed at positions corresponding to the first and second interruption positions within the guiding track 79, and the guiding track mating member 81 that mates with the guide member 73 functions as the holding pawl 81.

In this specific example, it is also desirable that a part of the guide member 73 have flexibility imparted to it at a thinned part of the material thereof.

In the another specific example of the present invention, as shown in FIG. 14(B), the guiding track 79 is formed as a long protrusion part 91 and, in this specific example, in addition to disposing an appropriate stopper member 85 at a position corresponding to the first interruption position P1 near the outer periphery of the guiding track 79, which is formed by the long protrusion part 91, and an appropriate stopper member 86 is disposed at a position corresponding to the second interruption position P4, as shown in FIG. 16(B).

The construction of the guiding track mating member 81 of this specific example, as shown by example in FIG. 16(B), is such that it straddles the guiding track 79 formed as the long protrusion part 91, and also so that the holding pawl 82 mating with the stopper members 85 and 86 causes, via an appropriate spring 93, the slider 92, which is inclined to one side, to mate with the ceiling part of the guiding track mating member 81 so that it can move freely up and down.

In this specific example, therefore, the guiding track mating member 81 serves also as the holding pawl 82.

In the various specific examples of the present invention described above, because the stoppers 85 and 86 have an inclined surface 93, past which the holding pawl 82 or the guiding track mating member 81 is capable of sliding, and a wall surface 94 capable of mating with the holding pawl 82 or the guiding track mating member 81, the construction is such that the holding pawl 82 or the guiding track mating member 81 is not able to slide along the guiding track 79 in a direction that is the opposite to the direction in which it had previously moved.

It is preferable that the guiding track 79 have a length L, which corresponds to the one stroke 64 from the position M, at which the insertion head portion 13 and the socket portion 15 are mounted in the loop pin connecting device 30, through movement to the position 63 at which there is mating caused between the insertion head portion 13 and the socket portion 15, and further that the guiding track 79 is made up of at least a first guiding track 87 used when the first feeding means 61 moves from a position N at which the insertion head portion 13 and the socket portion 15 are mounted into the loop pin connecting device 30 to the position 63 at which mating is caused to occur between the insertion head portion 13 and the socket portion 15, and a second guiding track 88, which is used at the time of reverse movement from the position 63 at which there is mutual mating between the insertion head portion 13 and the socket portion 15 to the position M at which the insertion head portion 13 and the socket portion 15 are mounted in the loop pin connecting device 30.

Next, by way of description of the configuration of yet another example of a loop pin connecting device 30 according to the present invention, as shown in FIG. 17(A), in this example, rather than using the stopper 85, a bent portion 101 is provided in the first guiding track 87 used at a position corresponding to the first interruption position P1 during the one stroke.

The first guiding track 87 in this example of the present invention has a bent portion 101 formed at minimally two locations thereof.

For example, as shown in FIG. 17(B), a second bent portion 102 can be provided at a position along the one stroke 64 of the first guiding track 87 corresponding to the second interruption position P4.

Furthermore, FIG. 17(A) shows an example in which the bent portion 101 is formed at a position corresponding to the first interruption position P1, and in which the stopper 86 is provided at a position corresponding to the second interruption position P4.

In this specific example of the present invention, the position at which the bent portion 101 is formed is variable and possible, based on the above-described technical concept, to freely set this to a position that is the most required position.

The bent portion 101 in the present invention can be configured by bending the guiding track at an angle such that the configuration thereof is such that the first feeding means 61 is capable of moving in the retreating direction by a pre-established amount in the direction toward the position M at which the insertion head portion 13 and the socket portion 15 are mounted in the loop pin connecting device 30.

Specifically, although there is no restriction with regard to the angle of bending in the bent portion 101 in the present invention, the guiding track mating member 81 moves in along the first guiding track 87, so that it first makes contact with the first bent corner portion 105 of the bent portion 101.

It is desirable that a stopper 107 be provided within the first guiding track 87 immediately before the bent portion 101, so that the guiding track mating member 81 does not return along the first guiding track 87 at this time.

By doing this, the forward movement of the insertion head portion 13 of the loop pin 10 is temporarily interrupted at the mating position 63, and when the operator releases the pulling force on the operation lever 22 slightly, the guiding track mating member 81 moves diagonally in reverse along the guiding track 108 bent in the bent portion 101, and stops when it reaches the second bent corner portion 106 of the bent portion 101.

Figure 16:
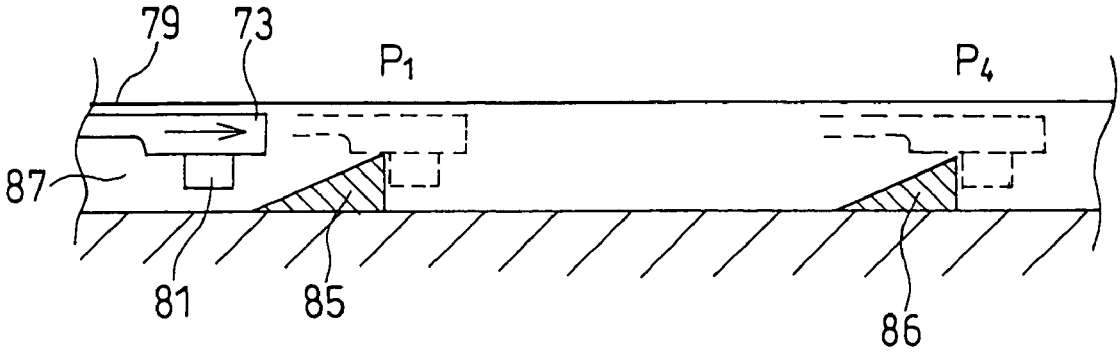
FIG. 16 is a drawing illustrating the configuration of another specific example of a guiding track in the present invention.
Figure 16:
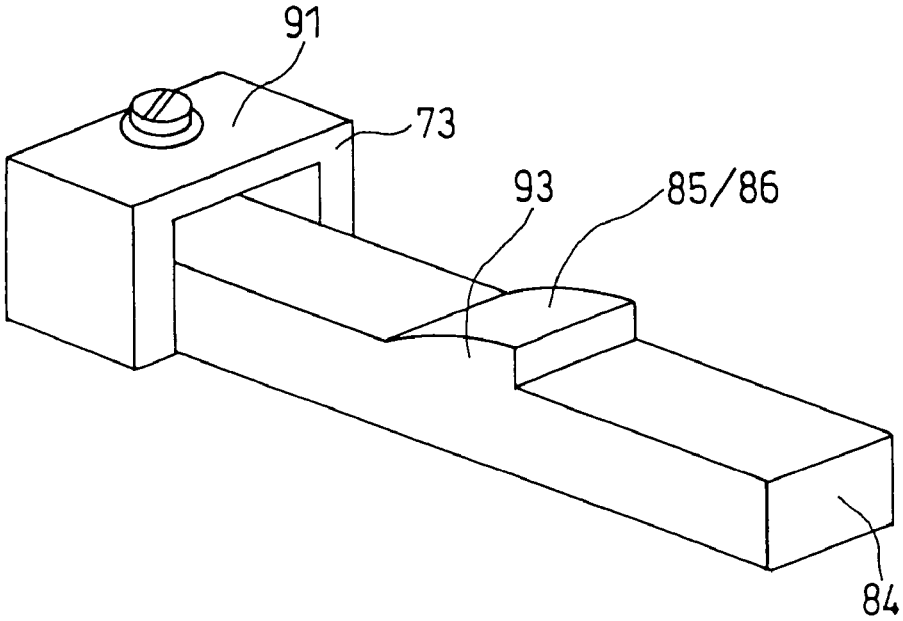
Figure 16:
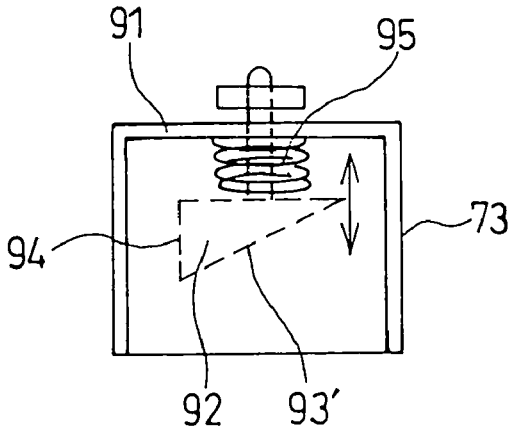

Although the foregoing constitution is sufficient in the present invention, it is desirable, in order that the guiding track mating member 81 does not retreat toward the first bent corner portion 105, that a separate stopper 118 be provided within the groove of the bent guiding track 108, configured as shown in FIG. 16.

Subsequent operation with this specific example is the same as the operation in the specific example described with reference to FIG. 14.

In this specific example, it is desirable to provide a stopper 110 having the configuration such as shown in FIG. 16, for the purpose of preventing the movement of the guiding track mating member 81 within the groove of the first guiding track 87 with in reverse with respect to the position 109, which is the position of complete mating between the insertion head portion 13 and the socket portion 15 reached by the guiding track mating member 81, and also for the purpose of causing movement of the guiding track mating member 81 in the guiding track 88 for the purpose of return movement of the guiding track mating member 81.

In the same manner, it is desirable in this specific example to provide a stopper 112 having a configuration such as shown in FIG. 16, so that there is no erroneous movement of the guiding track mating member 81 within the groove of the second guiding track 88 and into the groove 88 at the position 111 corresponding to the position of intersection between the second guiding track 88 and the first guiding track 87 at the start of the operation.

As is clear from the foregoing, the guiding track mating member 81, which mates with the guide 73 in this specific example, is configured so as to travel about a loop formed by the first and second guiding tracks 87 and 88.

Figure 17:
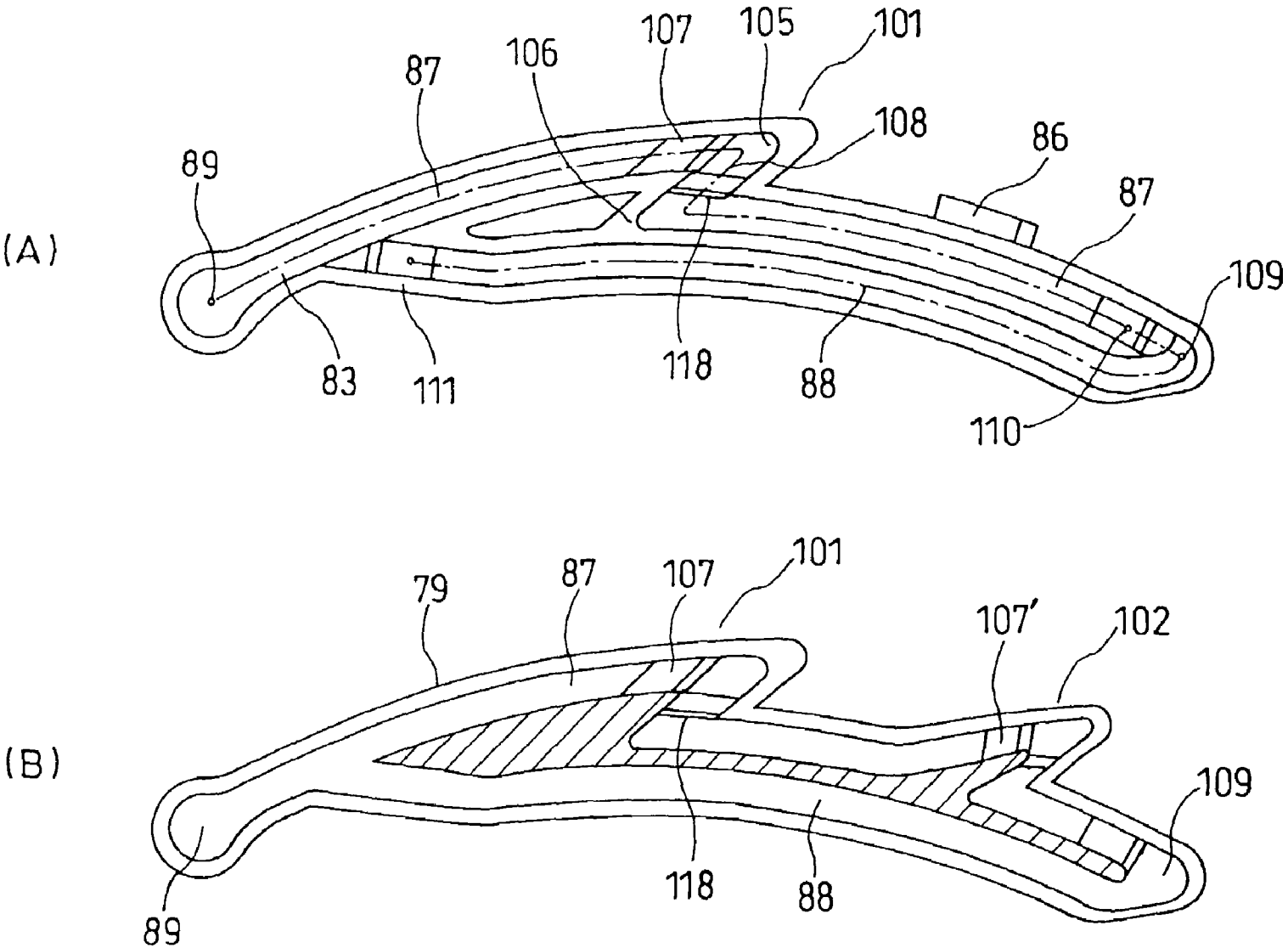
FIG. 17 is a drawing showing the configuration of a specific example of the stopper in the guiding track in the present invention.

As described above, The shape of the guiding track 79 in the present invention, in addition to what is shown in FIG. 17, encompasses the case in which there is no feeding operation interruption mechanism at the first interruption position P1, and there is a feeding operation interruption mechanism provided at only the second interruption position P4, and the case in which a feeding operation interruption mechanism is provided at the first interruption position P1, and a feeding operation interruption mechanism provided at the second interruption position P4.

The operation procedure in the case of using the specific example of the guiding track 79 shown in FIG. 17 to operate the loop pin connecting device 30 of the present invention, and the general movement of the guide member 73 of the operation interruption mechanism 65 and of the guiding track mating member 81 are described in detail below, with reference made to FIG. 18(A) through FIG. 18(E).

First, FIG. 18(A) shows the loop pin connecting device 30 in the condition just before it is operated, from which it can be seen that the guiding track mating member 81 provided on one part of the guide member 73 mounted to the end part of the feeding means driving mechanism 72 is positioned at the starting part 89 of the guiding track 79.

Next, when the operator operates the operation lever 22 of the loop pin connecting device 30, the guiding track mating member 81 moves along the forward groove 87 of the guiding track 79 and, as shown in FIG. 18(B), rides over the stopper 107, after which it comes into contact with the bent portion 101 provided so as to correspond to the first interruption position P1 in the guiding track 79, at which point it stops.

Figure 18:
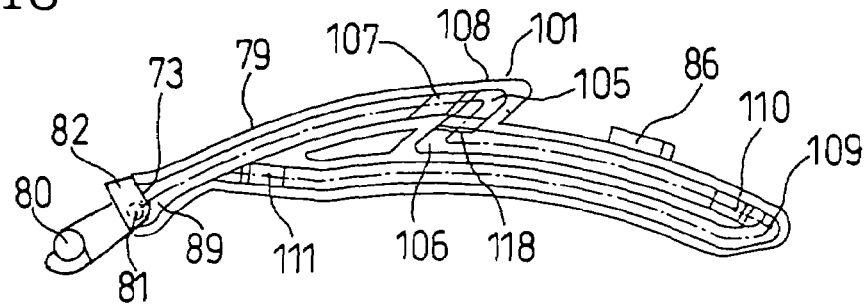
FIG. 18(A) through (E) are drawings illustrating the change in the mating condition between the guiding track mating member and the guiding track during the operation of the present invention.
Figure 18:
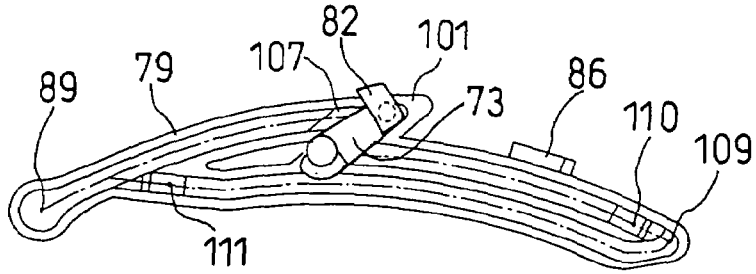
Figure 18:
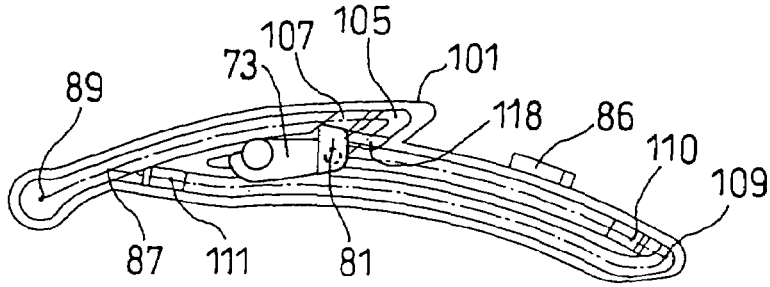
Figure 18:
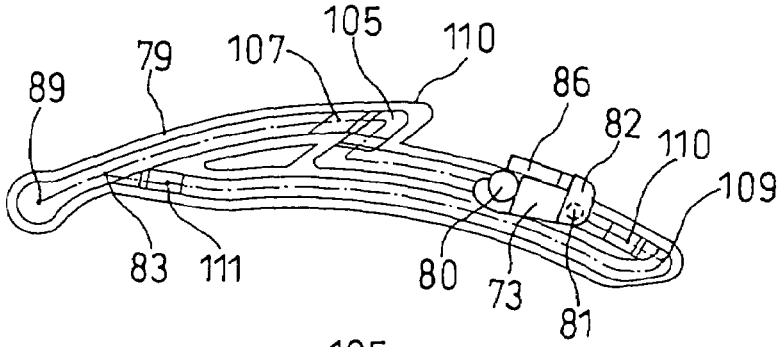
Figure 18:
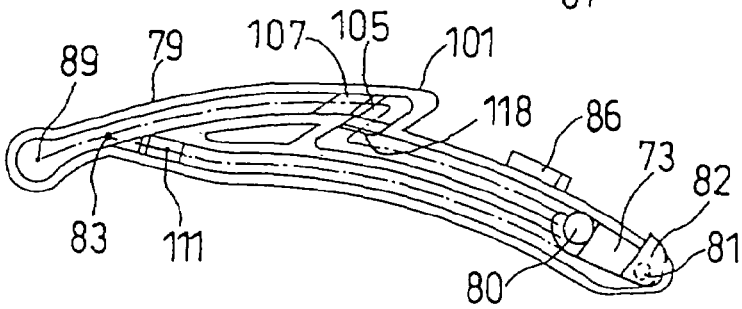

After the above, by the operator slightly releasing the force applied to the operation lever 22, as shown in FIG. 18 (C), the guiding track mating member 81 moves as far as this position and does not move in the reverse direction within the groove and, by the action of the stopper 107 and the action of the reverse direction bias force constantly applied to the guiding track mating member 81, the guiding track mating member 81 moves diagonally downward within the groove of the bent guiding track 108, passing over the stopper 118 and reaching the second bent corner portion 106, at which position the feeding operation of the first feeding means 61 is temporarily stopped, resulting in the insertion head portion 13 of the loop pin 10 being held in the stopped condition at a position protruding from the front surface of the loop pin connecting device 30, for example P1, which is some given distance from the front surface of the loop pin connecting device 30.

After the operator performs the prescribed above-described operation, when the operation lever 22 is operated once again, the guiding track mating member 81 starts to move along the first guiding track 87 toward the final end part 109 of the first guiding track 87, and as a result the forward feeding operation of the insertion head portion 13 by the first feeding means 61 is resumed, so that the remaining stroke in the one stroke 64 of the first feeding means 61 is performed.

When the operator finishes pulling on the operation lever 22 with the required force, if the mating between the insertion head portion 13 and the socket portion 15 is complete, as shown in FIG. 18(E) the guiding track mating member 81 rides over the stopper 110 and reaches the final end part 109 of the first guiding track 87.

After the above, by the operator releasing the force applied to the operation lever 22, the guiding track mating member 81 does not move in the reverse direction within the groove of the first guiding track 87, but rather moves along the guiding track for return of the guiding track mating member 81, this being the second guiding track 88, so as to return to the waiting position 89.

In the case, however, in which the operator believes the insertion head portion 13 was caused to mate completely with the socket portion 15, but in which in reality there was incomplete mating or no mating, or in the case in which the operator himself or herself recognizes the non-mated or incompletely mated condition between these two elements, by the operator slightly releasing the force applied to the operation lever 22, as shown in FIG. 18(D) the guiding track mating member 81 is caused to be fed in reverse a small amount only, so that the holding pawl 82 that forms the ratchet provided together with the guiding track mating member 81 mutually mates with the stopper 86 provided so as to correspond to the second interruption position P4, at which position the feeding operation of the first feeding means 61 is temporarily stopped, resulting in the insertion head portion 13 of the loop pin 10 being held in the stopped condition at the second interruption position P4.

After the above, by the operator once again operating the operation lever 22 so as to pull the operation lever 22 to the final position, the remaining part of the one stroke 64 of the feeding operation of the first feeding means 61 is executed, enabling the achievement of a complete mating between the insertion head portion 13 and the socket portion 15.

The operating condition after the above is the same as shown in the above-noted FIG. 18(E).

As is clear from the foregoing description, another basic configuration of the present invention a method for connecting a loop pin having a flexible filament, an insertion head portion having an appropriate mating part provided on one end of the filament, and a socket portion having a hole on the other end of the filament for irreversibly passing the insertion head portion of the filament, so that the insertion head portion mates into the socket portion, thereby forming a loop-shaped holder, whereby, when a first feeding means feeds the insertion head portion toward the front of the device, and a second feeding means feeds the socket portion toward the front of the device, for the purpose of causing mutual mating between the insertion head portion and the socket portion, during one stroke from a position at which the insertion head portion and the socket portion of the individual loop pins are set into the device such that the insertion head portion and socket portion are moved up to a position at which there is mutual mating therebetween, at least the forward operation of the insertion head portion is caused to stop temporarily at an arbitrary position during the first operation, after which the remaining operation during the one stroke is resumed.

In the above-noted method for connecting a loop pin according to the present invention, it is preferable that the operation of stopping the forward movement of the insertion head portion 13 is such that the feeding operation of the insertion head portion 13 is caused to stop between the loop pin feeding surface 66 of the loop pin connecting device 30 and the mating position 63, at which the insertion head portion 13 and the socket portion 15 mutually mate at the front of the loop pin connecting device 30, and so that the tip end part 67 of the insertion head portion 13 is at a first interruption position P1, which is closer to the loop pin feeding surface 66 than to the mating position 36.

Additionally, in the method for connecting a loop pin of the present invention, is also possible that the operation of stopping the forward movement of the insertion head portion be such that the that the feeding operation of the insertion head portion is caused to stop between the loop pin feeding surface of the loop pin connecting device and the mating position between the insertion head portion and the socket portion, and so that the end part of the insertion head portion is at a second interruption position, which is in close proximity to the mating position.

It is possible to configure the present invention so that the end part of the insertion head portion that protrudes from the loop pin feeding surface of the device is inserted through an opening or small hole in a product to which the loop pin is to be attached, after which the remainder of the one stroke is resumed, so as to cause mutual mating between the insertion head portion and the socket portion at the front of the device.

By adopting the above-described constitution, the present invention provides a loop pin connecting device for the purpose of fixing to a prescribed product a loop pin, so as to attach to the product a price tag, specifications regarding the product, or other instructions noting the method of use of the product, wherein the loop pin connecting device is capable of easily and efficiently passing the insertion head portion of the loop pin through a hole, opening, space or the like for the purpose of fixing the loop pin, wherein when shooting in the loop pin, in the case in which the mating between the insertion head portion and the socket portion of the loop pin is insufficient or in which there has not yet been mating, the operator is caused to notice this condition, and by causing the resumption of the remaining part of the stroke, there is an improvement in the work efficiency of the loop pin connecting device and prevention of jamming of the loop pin in the loop pin connecting device.

What is claimed is:

1. A loop pin connecting device that shoots out a loop pin, which has a flexible filament, an insertion head portion having an appropriate mating part provided on one end of the filament, and a socket portion having a hole on the other end of the filament for irreversibly passing the insertion head portion of the filament, so that the insertion head portion mates into the socket portion, thereby forming a loop-shaped holder, said loop pin connecting device comprising;

a first feeding means that feeds the insertion head portion toward the front of said device; and a second feeding means that feeds socket portion toward the front of the device, for the purpose of causing mutual mating between the insertion head portion and the socket portion, wherein during one stroke in which the insertion head portion and socket portion are moved from a position at which the insertion head portion and the socket portion of the individual loop pins are set into said device up to a position at which there is mutual mating therebetween, at least said first feeding means engages with a feeding operation interruption mechanism capable of temporarily stopping said feeding operation at an arbitrary position during said one stroke, said feeding operation interruption mechanism including a rotatable guide member provided on a device for moving said first feeding means, and a guiding track provided on an inside side wall of said loop pin connecting device and including at least a forward path, a return path and one feeding operation interruption position, said guide member having a post, said guide member engaging with said guiding track via said post, wherein said feeding operation interruption mechanism is configured so that said feeding operation of the insertion head portion is caused to stop at the interruption position, which is between a loop pin feeding surface of said loop pin connecting device and said mating position at which the insertion head portion and the socket portion mutually mate at the front of said loop pin connecting device, and further wherein said guide member is provided with a projection, said forward path of guiding track is provided with a protrusion, and said projection and said protrusion are configured with each other so that at said interruption position, said projection of said guide member can pass over said protrusion in a normal feeding operation, while at least when a pressure applied to an operation lever is reduced, said projection and said protrusion are engaged with each other so as to block said first feeding means from being returned back to its original position, wherein said post moves along the forward path until said insertion head portion mates with said socket portion, said post moving along the return path after mating, said projection not engaging said protrusion when said post is in the return path.

2. A loop pin connecting device according to claim 1, wherein said interruption position is selected from a group of a first interruption position between said loop pin feeding surface of said loop pin connecting device and said mating position at which the insertion head portion and said socket portion mutually mate at the front of said loop pin connecting device and at which the end part of said insertion head portion is closer to said loop pin feeding surface than to said mating position and a second interruption position between said loop pin feeding surface of said loop pin connecting device and said mating position at which the insertion head portion and said socket portion mutually mate at the front of said loop pin connecting device and at which there is no mating or incomplete mating between said insertion head portion and said socket portion and further at which the end part of the insertion head portion is in close proximity to said mating position.

3. A loop pin connecting device that shoots out a loop pin, which has a flexible filament, an insertion head portion having an appropriate mating part provided on one end of the filament, and a socket portion having a hole on the other end of the filament for irreversibly passing the insertion head portion of the filament, so that the insertion head portion mates into the socket portion, thereby forming a loop-shaped holder, said loop pin connecting device comprising;

a first feeding means that feeds the insertion head portion toward the front of said device; and a second feeding means that feeds socket portion toward the front of the device, for the purpose of causing mutual mating between the insertion head portion and the socket portion, wherein during one stroke in which the insertion head portion and socket portion are moved from a position at which the insertion head portion and the socket portion of the individual loop pins are set into said device up to a position at which there is mutual mating therebetween, at least said first feeding means engages with a feeding operation interruption mechanism capable of temporarily stopping said feeding operation at an arbitrary position during said one stroke, said feeding operation interruption mechanism including a rotatable guide member provided on a device for moving said first feeding means and a guiding track provided on an inside side wall of said loop pin connecting device and including at least a forward path, a return path and one feeding operation interruption position, said guide member having a post, said guide member engaging with said guiding track via said post, wherein said feeding operation interruption mechanism is configured so that said feeding operation of the insertion head portion is caused to stop at the interruption position, which is between a loop pin feeding surface of said loop pin connecting device and said mating position at which the insertion head portion and the socket portion mutually mate at the front of said loop pin connecting device, and further wherein said guide member is provided with a post and said forward path is provided with at least one interruption position comprising two successive folded portions, and further wherein said first and second folded portions are configured so that when said guide member reaches said first folded portion, said first folded portion prevents said guide member from going forward further until pressure applied to an operation lever is reduced, while said second folded portion temporarily receives said guide member so as to block said guide member from being returned back to its original position when pressure is reduced, said post continuing along the forward path to the end of the forward path when pressure is applied again, wherein said post moves along the forward path until said insertion head portion mates with said socket portion, said post moving along the return path after mating so as to avoid said folded portions.

4. A loop pin connecting device according to claim 3, wherein said interruption position is selected from a group of a first interruption position between said loop pin feeding surface of said loop pin connecting device and said mating position at which the insertion head portion and said socket portion mutually mate at the front of said loop pin connecting device and at which the end part of said insertion head portion is closer to said loop pin feeding surface than to said mating position and a second interruption position between said loop pin feeding surface of said loop pin connecting device and said mating position at which the insertion head portion and said socket portion mutually mate at the front of said loop pin connecting device and at which there is no mating or incomplete mating between said insertion head portion and said socket portion and further at which the end part of the insertion head portion is in close proximity to said mating position.

* * * * *